US006725946B2

(12) United States Patent
Howell, Jr.

(10) Patent No.: US 6,725,946 B2
(45) Date of Patent: Apr. 27, 2004

(54) EXCAVATION APPARATUS

(76) Inventor: Richard L. Howell, Jr., 5463 Robin Cir., Yorba Linda, CA (US) 92886

( * ) Notice: Subject to any disclaimer, the term of this patent is extended or adjusted under 35 U.S.C. 154(b) by 95 days.

(21) Appl. No.: 09/940,036

(22) Filed: Aug. 27, 2001

(65) Prior Publication Data

US 2003/0037940 A1 Feb. 27, 2003

(51) Int. Cl.[7] ..... F21C 5/12

(52) U.S. Cl. ..... 173/184; 173/147; 173/11; 173/27; 173/28; 173/29

(58) Field of Search ..... 173/184, 147, 173/11, 27–29

(56) References Cited

U.S. PATENT DOCUMENTS

| | | | | | |
|---|---|---|---|---|---|
| 1,971,922 | A | | 8/1934 | Smith | 173/44 |
| 2,480,537 | A | | 8/1949 | Arps et al. | 255/19 |
| 2,910,274 | A | | 10/1959 | Scott | 175/103 |
| 3,216,511 | A | | 11/1965 | Ladd et al. | 173/19 |
| 3,426,857 | A | | 2/1969 | Bland | 173/151 |
| 3,520,374 | A | | 7/1970 | Ebert | 173/147 |
| 3,753,468 | A | | 8/1973 | Casagrande | 173/147 X |
| 4,035,969 | A | | 7/1977 | Casagrande | 173/147 X |
| 4,137,974 | A | | 2/1979 | Decker | 173/151 X |
| 4,199,033 | A | * | 4/1980 | Van Gundy, Jr. | 173/27 |
| 4,627,499 | A | | 12/1986 | Magee et al. | 173/193 |
| 4,645,084 | A | | 2/1987 | Deike | 173/194 |
| 4,877,091 | A | | 10/1989 | Howell, Jr. | 173/89 |
| 5,343,962 | A | * | 9/1994 | Daigle et al. | 173/147 |
| 5,630,477 | A | | 5/1997 | Minatre | 173/147 |
| 5,746,277 | A | | 5/1998 | Howell, Jr. | 173/184 |
| 6,257,349 | B1 | * | 7/2001 | Bardwell | 173/147 |

FOREIGN PATENT DOCUMENTS

| | | | |
|---|---|---|---|
| GB | 2032494 | 5/1980 | 173/147 |

* cited by examiner

*Primary Examiner*—John Sipos
*Assistant Examiner*—Michelle López
(74) *Attorney, Agent, or Firm*—F. Eugene Logan

(57) ABSTRACT

An excavation apparatus especially useful when mounted on backhoes and other lighter vehicles used in the construction industry. The excavation apparatus does not require a winch for letting out and retracting its cable nor a reel for storing retracted cable which reduces the weight of the excavation apparatus, lowers its cost while facilitating both operation and servicing. The apparatus has a kelly assembly housing which houses an outer kelly section, and an extendable innermost kelly section adaptable for attachment of a tool. More than one extendable kelly section can be used. A rotary table rotates the kelly sections. A support structure supports the rotary table and the housing. A frame allows the housing to slide relative to the frame in a direction parallel to the axis of the assembly. A downcrowd mechanism, supported by the frame, downcrowds the support structure relative to the frame. A kelly deployment and retraction mechanism deploys all extendable inner kelly sections out of the housing and retracts them back into the housing. This mechanism has at least one kelly extension sheave supported by the frame, and a cable having one end attached to the innermost kelly section and a second end attached to either the support mechanism or the frame. The cable is alternately looped under lower extension, and over upper, extension sheaves so that the downcrowd mechanism also serves for letting out and retracting the cable.

32 Claims, 28 Drawing Sheets

EXCAVATION APPARATUS

BACKGROUND OF THE INVENTION

Nonrotating kelly sections are shown in a drilling device in U.S. Pat. No. 1,971,922. The weight of the device, which does not have a power downcrowding mechanism, forces the auger into the ground.

U.S. Pat. No. 3,216,511 shows a crawler track vehicle with a drop hammer on the end of the boom.

U.S. Pat. No. 3,426,857 shows a drilling device with a single kelly bar supported from the end of a boom of a track type vehicle. The single kelly bar slides through a housing of a rotatable guide which rotates the kelly bar. The rotatable guide is supported frame attached to the lower portion of the boom. No means of downcrowding is provided. Another rig with telescoping kelly sections is shown in U.S. Pat. No. 3,753,468. The outer kelly section slides axially within a guidance sleeve supported at its top end by the free end of the boom and at its bottom end by a hydraulic cylinder attached to the track type vehicle. Telescopic sections and control are also described in U.S. Pat. No. 4,035,969.

U.S. Pat. No. 4,137,974 shows telescoping kelly sections driven by a rotary table. The housing of the rotary table is mounted at the lower end of relatively tall derrick. The kelly sections when retracted are surrounded by the derrick structure. Downcrowding is achieved by a mechanism which includes a drum having two cables wound in opposite senses thereon. The drum is hydraulically driven. A pulley system is mounted on the top of the derrick and another pulley system is mounted on the top of the outer kelly section. The pulley systems and the derrick would make it difficult to interchange the kelly sections since free access to the top of the kelly sections is not possible in such a rig.

An augering device mounted on a backhoe is shown in U.S. Pat. No. 4,199,033. The downward force exerted by the boom of the backhoe drives the auger into the ground. A trunnion device mounted between the end of the boom and the augering device allows a variety of angles of the auger relative to the backhoe.

U.S. Pat. No. 4,627,499 shows a drilling device supported on the end of a boom of a track type vehicle. The drilling device is of the drill mast type with a single kelly bar which slides through a housing of a final drive unit. The axis of the mast and kelly bar appear to be the same. Because the mast is directly over the kelly bar a relatively high overhead or ceiling is required for drilling vertical holes.

U.S. Pat. No. 4,645,084 discloses a device for drilling holes mounted in the side panels of a truck bed. A hydraulic jack is used to downcrowd the casing relative to the elbow.

A more useful downcrowdable augering apparatus having kelly sections is disclosed in U.S. Pat. No. 4,877,091. The apparatus of U.S. Pat. No. 4,877,091 is very useful in sites having low overhead or ceiling. In U.S. Pat. No. 4,877,091 the kelly rotating means is bolted directly to the outer kelly section and as a consequence the outer kelly section is not permitted to slide through the kelly rotating means. Since the top of the kelly assembly is closed changing and/or replacing the kelly sections is more difficult than if the top of the outer kelly section were open.

Another useful downcrowdable augering apparatus having kelly sections is disclosed in U.S. Pat. No. 5,746,277 which is concerned with making such apparatus and rigs readily adaptable to mounting on a wide variety of vehicles ranging from light truck beds a to large track type vehicles including caterpillar type machines. The invention facilitates maintenance and changing of kelly assemblies by its unobstructed access to the top of the kelly assembly. For example the top of the kelly assembly is free of rotary drive mechanisms and pulleys associated therewith. U.S. Pat. Nos. 4,877,091 and 5,746,277 are hereby incorporated herein by reference.

Non-limiting examples of vehicles in which the augering means of this invention can be used are shown in U.S. Pat. Nos. 4,199,033 and 5,746,277 for backhoes and light trucks, and U.S. Pat. No. 3,216,511, U.S. Pat. No. 4,627,499 and U.S. Pat. No. 4,877,091 for crawler vehicles with rotatable booms.

In the present invention the excavation apparatus does not require a winch for letting out and retracting the cable. Nor does the present invention require a reel for storing the retracted cable. Since this invention does not require a winch, it also does not require a motor to drive a winch. Accordingly, the excavation apparatus of this invention is not as heavy. This simplification and other improvements in construction allow this invention to be cheaper to manufacture, maintain and use.

SUMMARY OF THE INVENTION

The present invention is directed to an excavation apparatus which can be adapted to a variety of vehicles including smaller excavating machines such as backhoes and small trucks. The excavation apparatus can be quickly and easily connected and disconnected to vehicles by a one or two persons with a minimum of tools thereby allowing such vehicles to be converted as needed. For example, the smaller rear bucket on backhoes can quickly removed and the excavation apparatus of this invention installed in place of the rear bucket in about twenty minutes including the required hydraulic lines.

Accordingly, there is provided by the principles of the present invention an excavation apparatus comprising kelly assembly means having a kelly assembly housing, an outer kelly section, and an extendable inner kelly section adaptable for attachment of a tool. The excavation apparatus includes kelly rotation means for rotating the kelly sections relative to the kelly assembly housing, support means for supporting the kelly rotation means and the kelly assembly means, frame means for allowing the kelly assembly housing to slide relative to the frame means in a direction parallel to the axis of the kelly assembly means, and downcrowd means for downcrowding the support means relative to the frame means.

The downcrowd means has a first end connected to and supported by the frame means, and a second end connected to and supporting the support means.

The excavation apparatus also includes kelly deployment and retraction means for deploying the extendable inner kelly section out of the kelly assembly housing and for retracting the extendable inner kelly section back into the kelly assembly housing. The kelly deployment and retraction means has at least one kelly extension sheave supported by the frame means, and a cable having a first end attached to the extendable inner kelly section and a second end attached directly or indirectly to either the support means or the frame means depending on the total number of kelly extension sheaves. The cable is looped alternatively under and over said at least one kelly extension sheave. The downcrowd means also serves as means for letting out and retracting the cable, thereby enabling the excavation apparatus to function without a winch for letting out and retracting the cable and without a reel for storing the retracted cable.

In one embodiment, the kelly assembly means has a kelly assembly housing, a non-extendable outer kelly section, and at least one extendable kelly section which includes an innermost kelly section adaptable for attachment of a tool thereto. In this embodiment, the kelly deployment and retraction means deploys the extendable kelly sections out of the kelly assembly housing and retracts the extendable inner kelly sections back into the kelly assembly housing.

In one embodiment, the kelly assembly means includes at least one extendable middle kelly section disposed between the innermost kelly section and the outer and non-extendable kelly section.

In another embodiment, the kelly assembly means includes at least guide rail means attached on an outside wall of the kelly assembly housing, and the frame means includes at least bearing channel means effective for sliding along the guide rail means and preventing rotation of the kelly assembly housing relative to the frame means.

In still another embodiment, the kelly rotation means includes at least a kelly drive shroud for rotatably driving the outer kelly section. In a further embodiment, the excavation apparatus includes rotary motor means for driving the kelly rotation means, and in a preferred embodiment, the excavation apparatus including two rotary motors for driving the kelly rotation means.

In one embodiment, the kelly assembly housing is attached to and supported by the support means.

In one embodiment, the downcrowd means is hydraulically powered. In another embodiment, the downcrowd means includes a multistage hydraulic cylinder.

In one embodiment, the kelly deployment and retraction means includes at least redirect cable support means for directing the cable between the innermost kelly section and a kelly extension sheave. In a further embodiment, the kelly deployment and retraction means also includes at least one kelly extension sheave rotatably supported by the support means. In a still further embodiment, the cable is looped over the kelly extension sheave rotatably supported by the support means.

In another embodiment, said at least one kelly extension sheave includes a plurality of lower kelly extension sheaves rotatably supported by the frame means and a plurality of upper kelly extension sheaves rotatably supported by the support means. In a further embodiment, the cable is alternately deployed under lower, and over upper, kelly extension sheaves.

In one embodiment, the second end of the cable is attached directly or indirectly to the support means if the total number of lower and upper sheaves is an odd number. In another embodiment, the second end of the cable is attached directly or indirectly to the frame means if the total number of extension sheaves is an even number. In still another embodiment, the plurality of lower kelly extension sheaves is four and the plurality of upper kelly extension sheaves is three.

In one embodiment, the frame means includes vehicle-connection means for connecting to a distal end of the boom means of a vehicle. In a further embodiment, wherein the vehicle has both a boom means and associated tilt means, the frame means includes both boom-connection means for connecting to a distal end of the boom member, and tilt-connection means for connecting to a distal end of the tilt means.

In one embodiment, the excavation apparatus further includes hydraulically powered rotary motor means for driving the kelly rotation means. In a further embodiment, wherein the vehicle has a hydraulic system, the excavation apparatus includes means for hydraulically connecting the vehicle's hydraulic system to the hydraulically powered rotary motor means. In a still further embodiment, where there is a need to use vehicle with multiple excavation tools, the means for hydraulically connecting the vehicle's hydraulic system to the hydraulically powered rotary motor means includes quick connect hydraulic means.

In one embodiment, the downcrowd means is hydraulically powered. In a further embodiment, wherein the vehicle has a hydraulic system, the excavation apparatus further includes means for hydraulically connecting the vehicle's hydraulic system to the hydraulically powered downcrowd means. In a still further embodiment, the means for hydraulically connecting the vehicle's hydraulic system to the hydraulically powered downcrowd means includes quick connect hydraulic means.

In another embodiment, the excavation apparatus is for removable and pivotable attachment to boom means of an excavation machine. In a further embodiment, wherein the boom means of the excavation machine has a front boom hinged to a back boom, the boom-connection means of the frame means of the excavation apparatus is pivotally connected to a distal end of the front boom.

The excavation machines to which the excavation apparatus of this invention are especially useful can be selected from the group consisting of backhoes, including backhoes having a boom extension member. However, this invention can also be used on pick-up trucks and other lighter weight vehicles adapted with an arm effective for connecting to the boom-connection means of the excavation apparatus.

DESCRIPTION OF THE PREFERRED EMBODIMENTS

Figure 1:
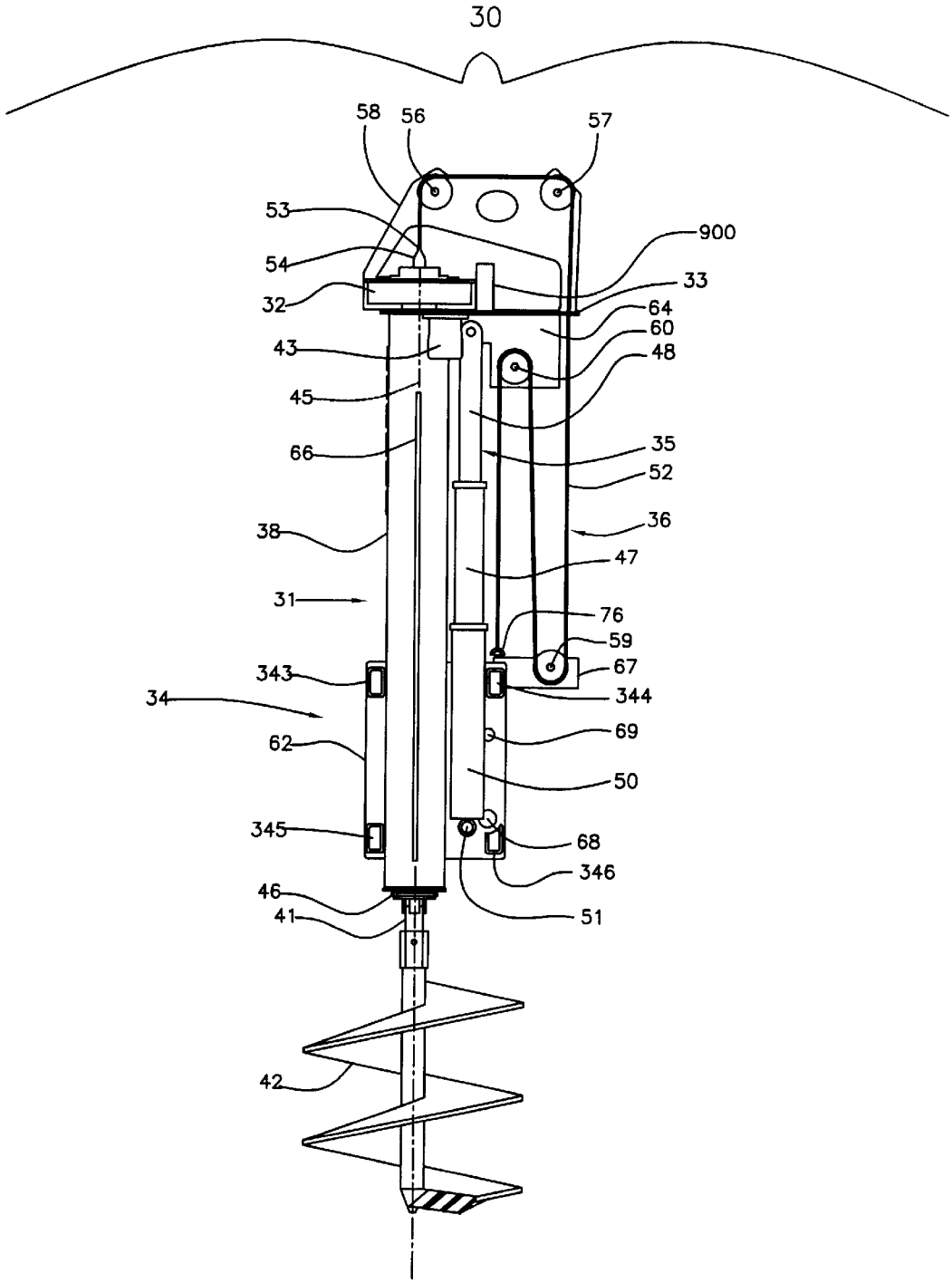
FIG. 1 is a left side view of a first embodiment of an excavation apparatus of this invention with three kelly sections fully retracted.
Figure 2:
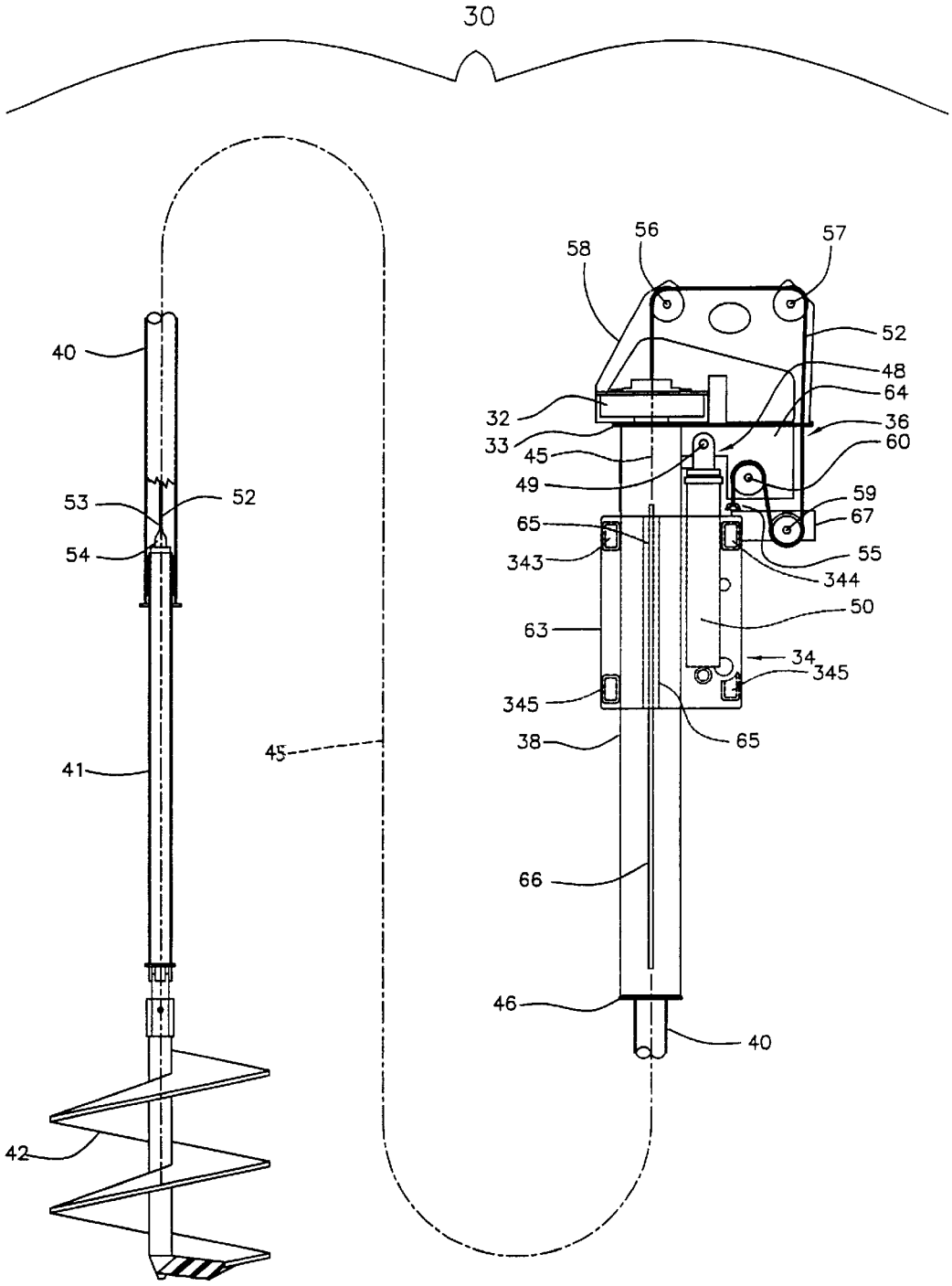
FIG. 2 is a left side view of the excavation apparatus of FIG. 1 with the kelly sections fully extended.

A first embodiment 30 of the excavation apparatus of this invention is shown functionally and schematically in FIGS. 1 and 2 which comprises kelly assembly means 31, kelly rotation means 32, support means 33, frame means 34, downcrowd means 35, and kelly retraction means 36.

Kelly assembly means 31 comprises kelly assembly housing 38 which houses three kelly sections, specifically outer kelly section 39, middle kelly section 40 and inner kelly section 41. Outer kelly section 39 remains within kelly assembly housing 38 at all times and does not extend therefrom. Kelly rotation means 32 rotates outer kelly section 39 which in turn rotates middle kelly section 40 which in turn rotates inner kelly section 41. Augering tool means 42 is attached to the bottom of inner kelly section 41 and rotates therewith.

Support means 33 directly or indirectly supports kelly assembly means 31, kelly rotation means 32 and rotary motor 43. Rotary motor 43 drives kelly rotation means 32.

Frame means 34 permits kelly assembly housing 38 to slide in a direction which is parallel to the axis 45 of kelly assembly means 31. In embodiment 30 the direction of the movement of the kelly assembly means is also coaxial with axis 45. Frame means 34 supports downcrowd means 35 which, in this embodiment, comprises two stage hydraulic cylinder 47 having the top distal end of the inner rod 48 pivotally connected by pin means 49 to support means 33, with the hydraulic cylinder housing 50 pivotally connected by pin means 51 directly or indirectly to frame means 34.

In embodiment 30 kelly retraction means 36 comprises cable 52 having one end 53 swivelly attached to the top 54 of inner kelly section 41 and its other end 55 attached to frame means 34. Cable 52 runs from end 53 upwards and over cable redirect sheaves 56 and 57 which are rotatably mounted on redirect sheaves support means 58, downward and under kelly extension sheave 59 which is rotatably mounted directly or indirectly on frame means 34, upwards and over kelly extension sheave 60 which is rotatably mounted directly, or indirectly by bracket 64, on support means 33, and downward to frame means 34 where cable end 55 is attached. Redirect sheaves support means 58 is supported directly or indirectly by support means 33. Kelly extension sheave 59 is shown directly supported by bracket 67 with is supported by frame means 34.

It can be seen that when hydraulic cylinder 47 is in its fully extended position shown in FIG. 1, middle and inner kelly sections are 40 and 41, respectively, are fully retracted into kelly assembly housing 38. However, as hydraulic cylinder 47 is retracted, as shown in FIG. 2, support means 33 is pulled towards frame means 34 while simultaneously permitting cable 52 to be played out thereby allowing the middle and inner kelly sections to extend out of and below the lower end 46 of kelly assembly housing 38. The combined weight of the middle and inner kelly sections 40 and 41, respectively, and augering tool means 42 keeps the cable taut.

Retracting the kelly sections merely requires reversing the procedure; specifically, extending the rods of the hydraulic cylinder 47 to their fully extended positions, as shown in FIG. 1, which automatically and simultaneously retrieves that portion of the cable which was played out during downcrowding of the support means 33 by the retraction of the rods of the hydraulic cylinder 47.

Thus, it can be seen that in this invention, no winch is required to retract the cable or the kelly sections, thereby simplifying the excavation apparatus and lowering the manufacturing cost.

In this embodiment, for every foot that support means 33 is pulled towards frame means 34, three feet of cable 52 is lowered into kelly assembly means 31 thereby lowering augering means 42 the aforementioned three feet plus one foot more due to downcrowding of the kelly assembly means itself or four foot total below frame means 34.

Frame means 34 comprises a right member 62, a left member 63, and four cross members 343, 344, 345 and 346 which secure left member 63 rigidly to right member 62. Both right and left members 62 and 63 have a channel forming members 65 for receiving right and left guide rails 66 mounted on diagonally opposed sides of kelly assembly housing 38. Channel forming members 65 are designed to permit guide rails 66 and hence kelly assembly means 32 to slide up and down only in the direction of axis 45.

The excavation apparatus 30 can be mounted on a support structure (not shown in FIGS. 1 and 2) using pins or bolts placed through bores 68 and 69 in the tilt-connection portion of frame means 34. For example, the distal end of a fixed boom (not shown in FIGS. 1 and 2) can be pivotally connected to frame means 34 by a pin or bolt through bore 68 thereby enabling excavation apparatus 30 to be pivoted about the axis of bore 68. Likewise the distal end of a hydraulic cylinder rod can be pivotally connected to frame means 34 by a pin or bolt through bore 69 with the distal end of the hydraulic cylinder body pivotally connected near the other end of the boom. With such an arrangement the excavation apparatus can be controllably tilted off vertical as desired.

Figure 3:
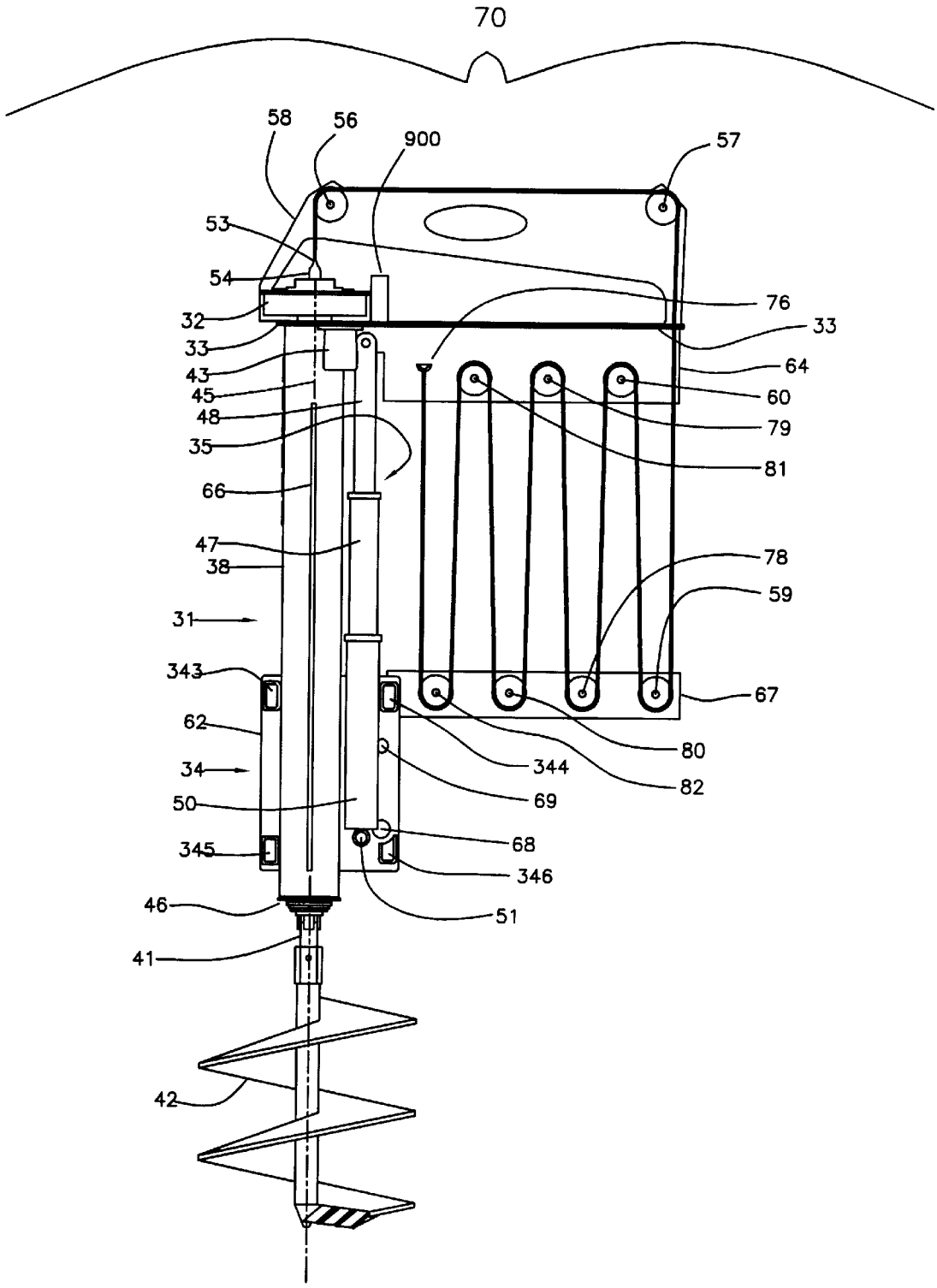
FIG. 3 is a left side view of a second embodiment of an excavation apparatus of this invention with five kelly sections fully retracted.
Figure 4:
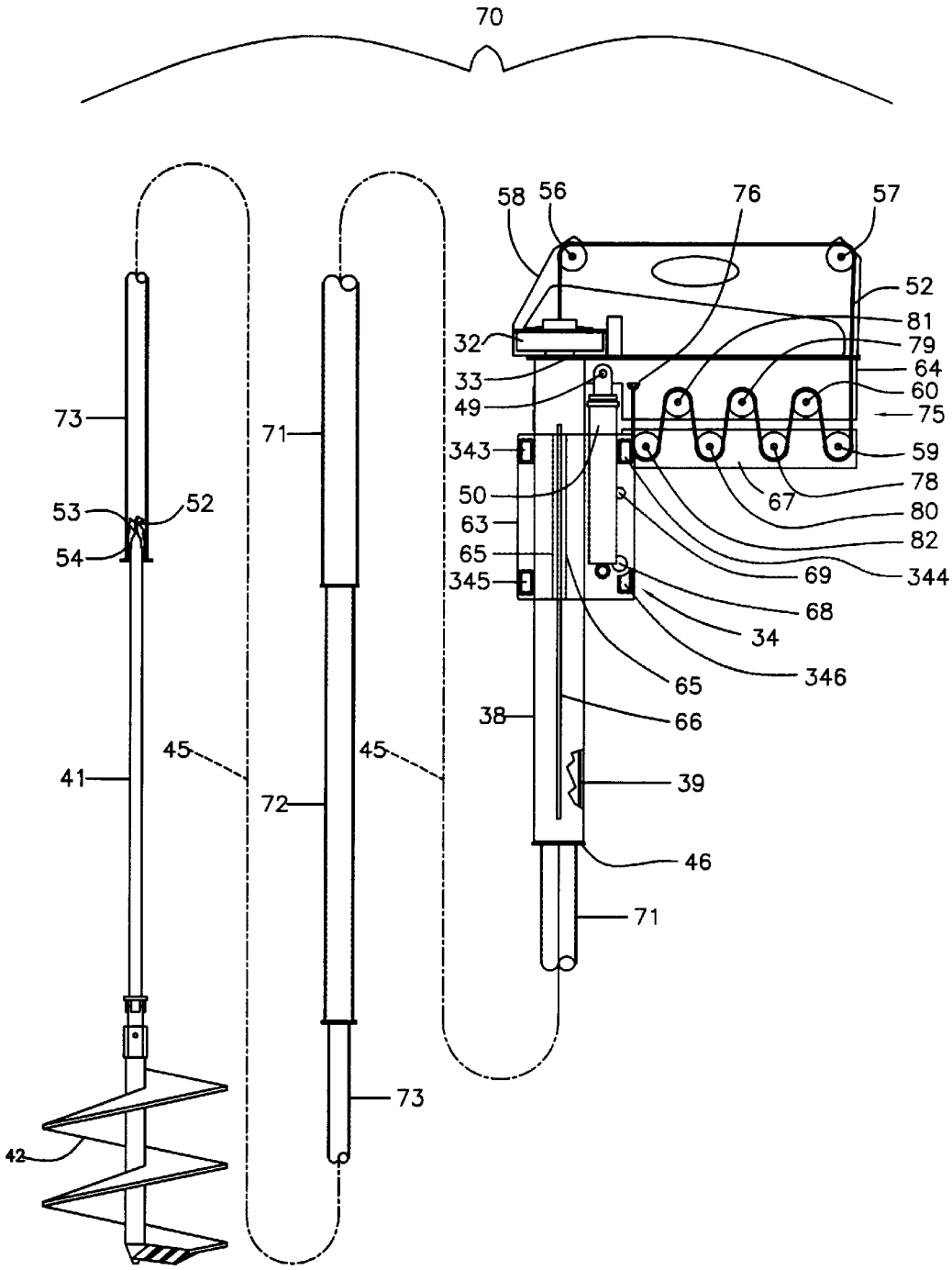
FIG. 4 is a left side view of the excavation apparatus of FIG. 3 with the kelly sections fully extended.

A second embodiment 70 of the excavation apparatus of this invention is shown functionally and schematically in FIGS. 3 and 4 which, as in the first embodiment 30, also comprises kelly assembly means 31, kelly rotation means 32, support means 33, frame means 34, downcrowd means 35, and a kelly retraction means 75.

Components of embodiment 70 having the same element number as that of embodiment 30 perform the same function in the same manner as described above with reference to FIGS. 1 and 2.

Kelly assembly means 31 comprises kelly assembly housing 38 which houses five kelly sections, specifically outer kelly section 39, middle kelly sections 71, 72 and 73 and inner kelly section 41. As in all embodiments of this invention, outer kelly section 39 remains within kelly assembly housing 38 at all times and does not extend therefrom. Kelly rotation means 32 rotates outer kelly section 39 which in turn rotate middle kelly sections 71, 72 and 73, which in turn rotates inner kelly section 41. Augering tool means 42 is attached to the bottom of inner kelly section 41 and rotates therewith.

In embodiment 70, however, kelly retraction means 75 comprises seven kelly extension sheaves, three of which are rotatably supported directly or indirectly by support means 33, and four of which are rotatably supported directly or indirectly by frame means 34. In this embodiment, cable 52 has one end 53 swivelly attached to the top 54 of inner kelly section 41 and its other end 76 attached to frame means 34. Cable 52 runs from end 53 upwards and over cable redirect sheaves 56 and 57, downward and under kelly extension sheave 59, upwards and over kelly extension sheave 60, downward and under kelly extension sheave 78, upwards and over kelly extension sheave 79, downward and under kelly extension sheave 80, upwards and over kelly extension sheave 81, downward and under kelly extension sheave 82, and upward to support means 32 where cable end 76 is attached.

It can be seen that when hydraulic cylinder 47 is in its fully extended position shown in FIG. 3, middle and inner kelly sections 71, 72, 73 and 41, are fully retracted into kelly assembly housing 38. However, as hydraulic cylinder 47 is retracted, as shown in FIG. 4, support means 33 is pulled towards frame means 34 while simultaneously permitting cable 52 to be played out thereby allowing the middle and inner kelly sections to extend out of and below the lower end 46 of kelly assembly housing 38. The combined weight of the middle and inner kelly sections 71, 72, 73 and 41, and augering tool means 42 keeps the cable taut.

As in embodiment 30, retracting the kelly sections in embodiment 70 merely requires reversing the procedure; specifically, extending the rods of the hydraulic cylinder 47 to their fully extended positions, as shown in FIG. 3, which automatically and simultaneously retrieves that portion of the cable which was played out during downcrowding of the support means 33. Thus, it can be seen that in embodiment 70, no winch is required to retract the cable or the kelly sections, thereby simplifying the excavation apparatus and lowering the manufacturing cost.

In embodiment 70, for every foot that support means 33 is pulled towards frame means 34, eight feet of cable 52 is lowered into kelly assembly means 31 thereby lowering augering means 42 the aforementioned eight feet plus one foot more due to downcrowding of the kelly assembly means itself or nine foot total below frame means 34.

Figure 5:
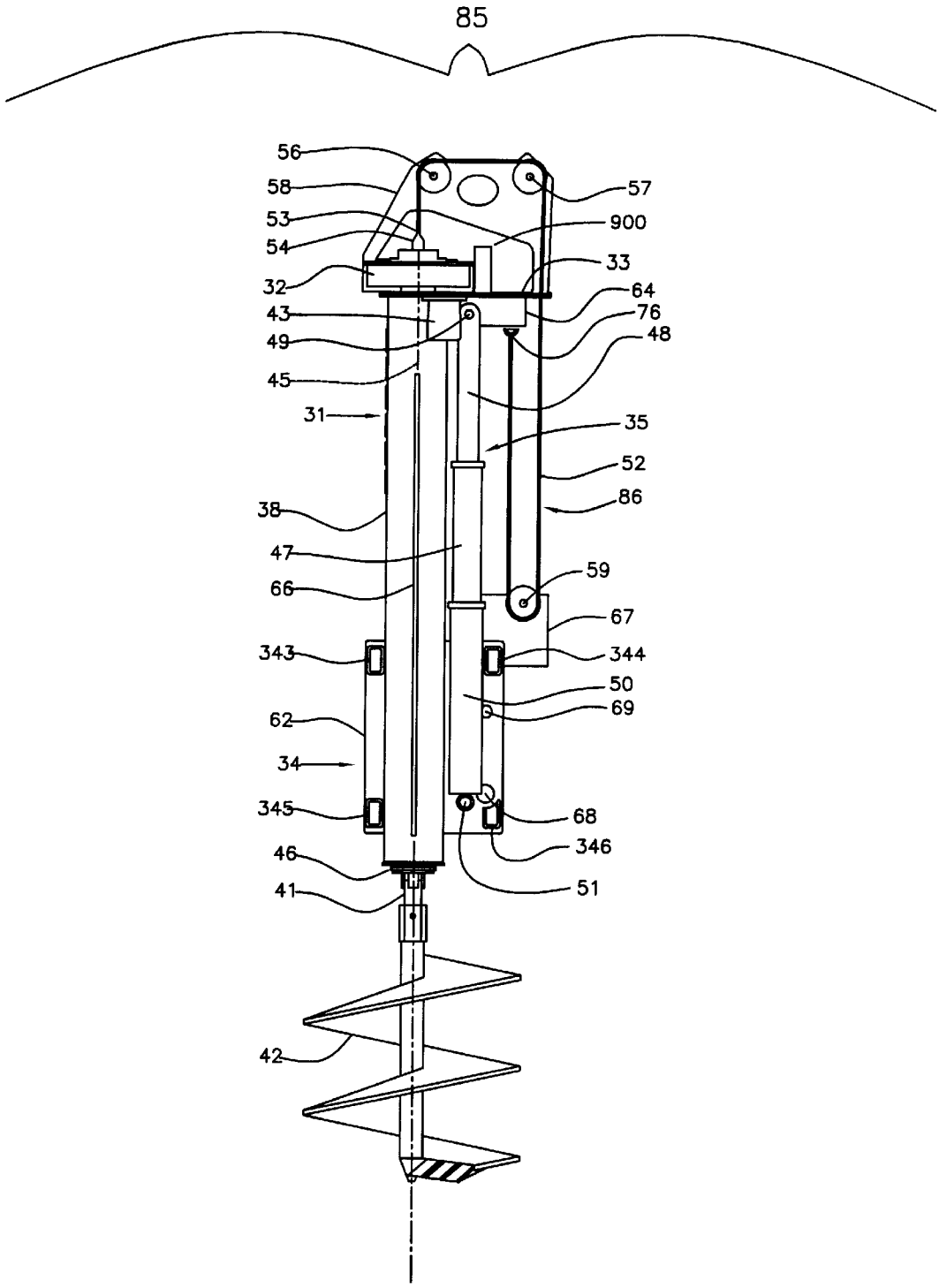
FIG. 5 is a left side view of a third embodiment of an excavation apparatus of this invention with two kelly sections fully retracted.
Figure 6:
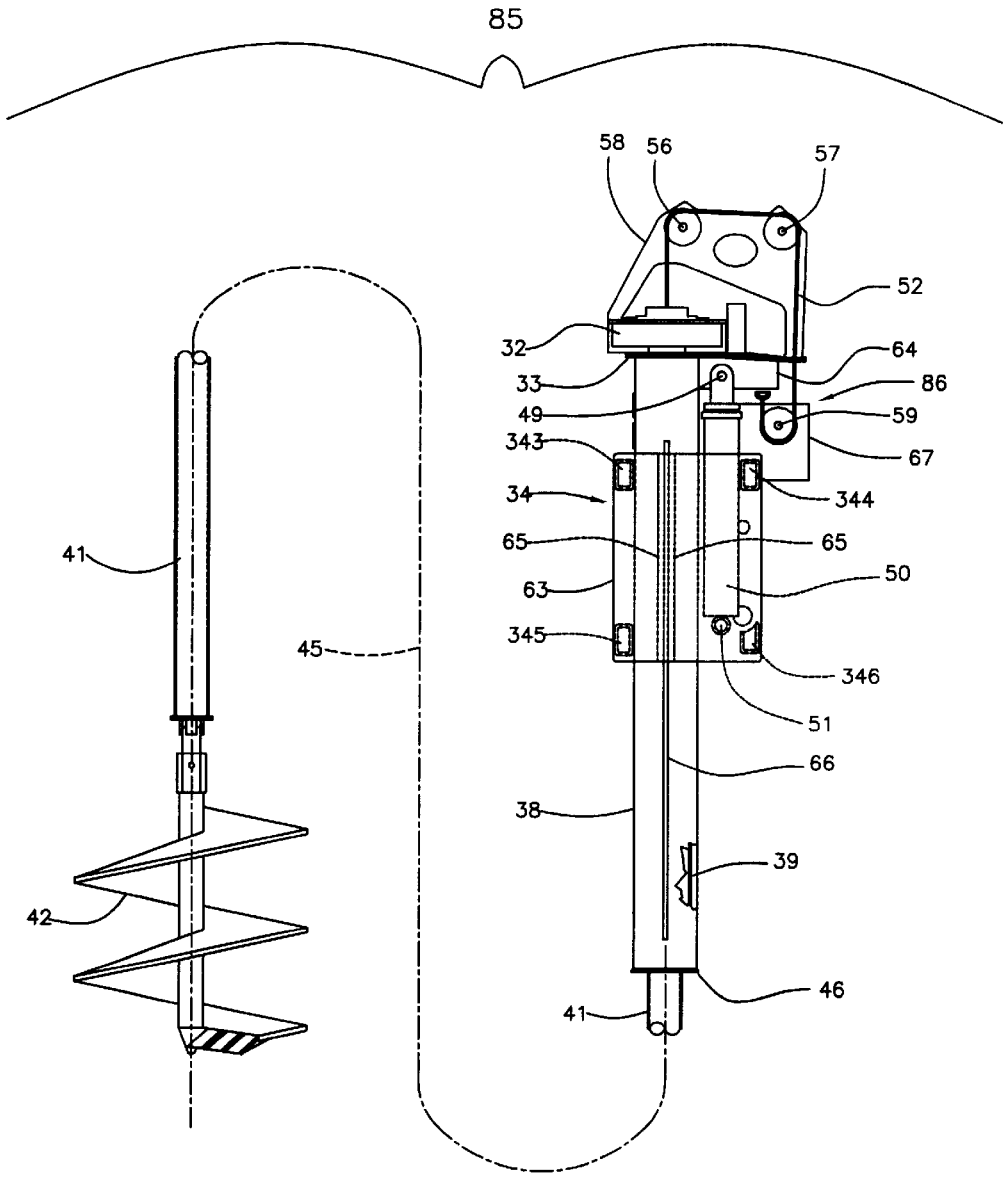
FIG. 6 is a left side view of the excavation apparatus of FIG. 1 with the kelly sections fully extended.

A third embodiment 85 of the excavation apparatus of this invention is shown functionally and schematically in FIGS. 5 and 6 which, are similar to the first embodiment 30 except that there are only two kelly sections and kelly extension sheave 60 has been omitted.

Components of embodiment 85 having the same element number as that of embodiments 30 and 70 perform the same function in the same manner as described above with reference to FIGS. 1–4.

Kelly assembly means 31 comprises kelly assembly housing 38 which houses two kelly sections, specifically outer kelly section 39 and inner kelly section 41. As in all embodiments of this invention, outer kelly section 39 remains within kelly assembly housing 38 at all times and does not extend therefrom. Kelly rotation means 32 rotates outer kelly section 39 which in turn rotates inner kelly section 41 which rotates augering tool means 42.

In embodiment 85, however, kelly retraction means 86 has but one kelly extension sheave 59 which is rotatably supported directly or indirectly by frame means 34. In this embodiment, cable 52 has one end 53 swivelly attached to the top 54 of inner kelly section 41 and its other end 76 attached to support means 33. Cable 52 runs from end 53 upwards and over cable redirect sheaves 56 and 57, downward and under kelly extension sheave 59, and upward to support means 32 where cable end 76 is attached.

When hydraulic cylinder 47 is in its fully extended position as shown in FIG. 5, inner kelly section 41 is fully retracted into kelly assembly housing 38. However, as hydraulic cylinder 47 is retracted, as shown in FIG. 6, support means 33 is pulled towards frame means 34 while simultaneously permitting cable 52 to be played out thereby allowing the inner kelly section to extend out of and below the lower end 46 of kelly assembly housing 38. The combined weight of the inner kelly section 41 and augering tool means 42 keeps the cable taut.

As in embodiments 30 and 70, retracting the kelly sections in embodiment 85 merely requires reversing the procedure; specifically, extending the rods of the hydraulic cylinder 47 to their fully extended positions, as shown in FIG. 5, which automatically and simultaneously retrieves that portion of the cable which was played out during downcrowding of the support means 33. Thus, it can be seen that in embodiment 85, no winch is required to retract the cable or the kelly sections, thereby simplifying the excavation apparatus and lowering the manufacturing cost.

In embodiment 85, for every foot that support means 33 is pulled towards frame means 34, two feet of cable 52 is lowered into kelly assembly means 31 thereby lowering augering means 42 the aforementioned two feet plus one foot more due to downcrowding of the kelly assembly means itself or three foot total below frame means 34.

FIGS. 1–6 are schematic diagrams to show how the kelly extension sheaves function to extend the cable into and out of the kelly assembly means. In practice, however, the upper and lower kelly extension sheaves are preferably rotatably mounted on a common upper and lower shafts, respectively, with the axis of the common shafts perpendicular to that shown in FIGS. 1–6. Such arrangement produces a more compact design as will be seen in the following embodiment where, as in embodiment 70, there are seven kelly extension sheaves.

A fourth embodiment 100 of the excavation apparatus of this invention is shown in FIGS. 7 to 35 which, is similar in some aspects to the second embodiment 70.

Figure 7:
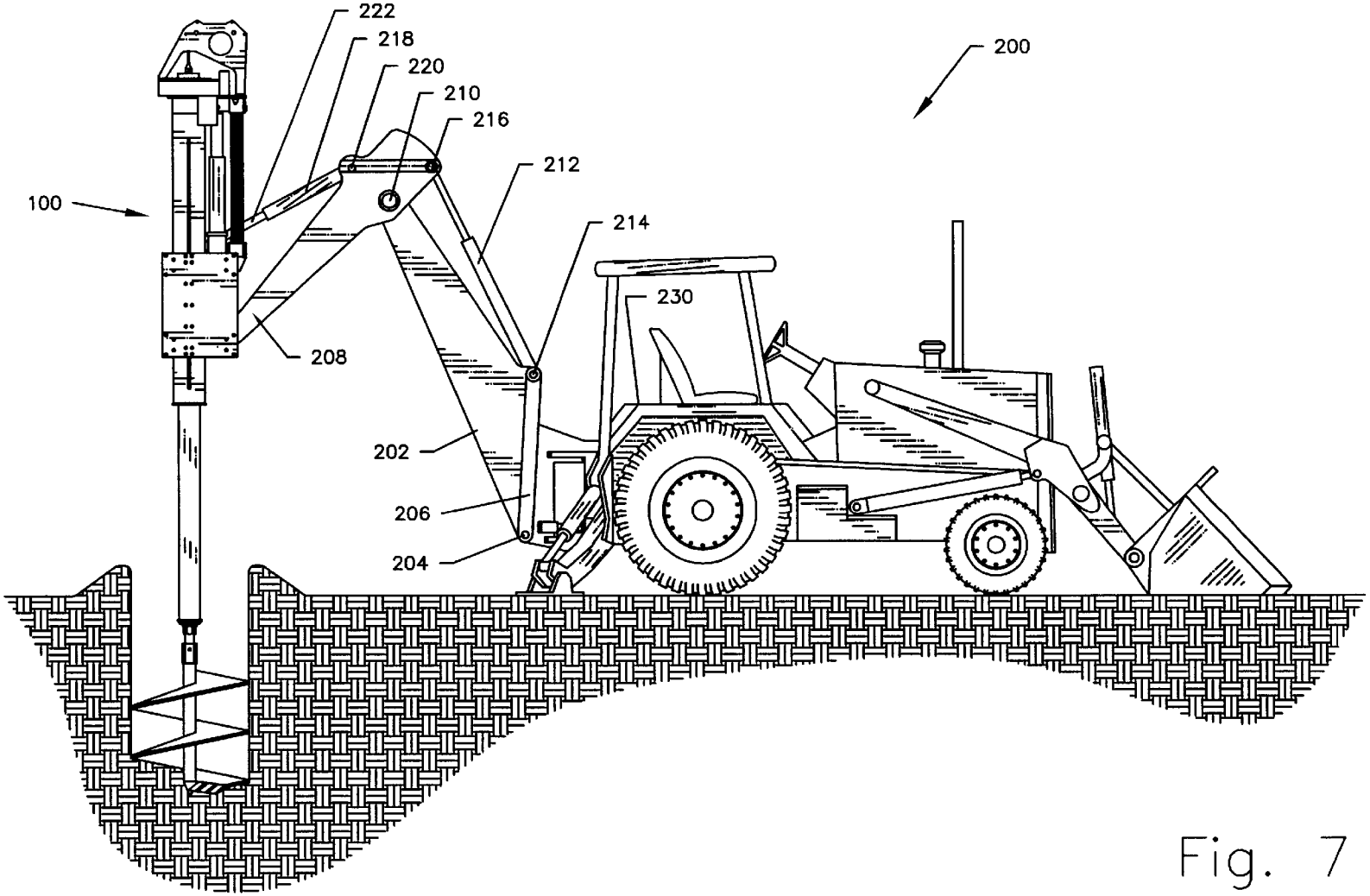
FIG. 7 is a left side view of a fourth embodiment of an excavation apparatus of this invention mounted on a backhoe.

Accordingly, FIG. 7 shows a fourth embodiment 100 of this invention illustrating an excavation apparatus pivotally connected to a conventional backhoe 200. Backhoe 200 has a primary boom 202 pivotally connected at point 204 to backhoe support frame member 206. Secondary boom 208 is pivotally connected at point 210 to primary boom 202. The base of hydraulic cylinder 212 is pivotally connected at point 214 to boom 202. The distal end of the hydraulic cylinder rod is pivotally connected at point 216 to boom 208, thereby enabling boom 208 to be pivoted in the plane of boom 202 in a conventional manner.

Figure 8:
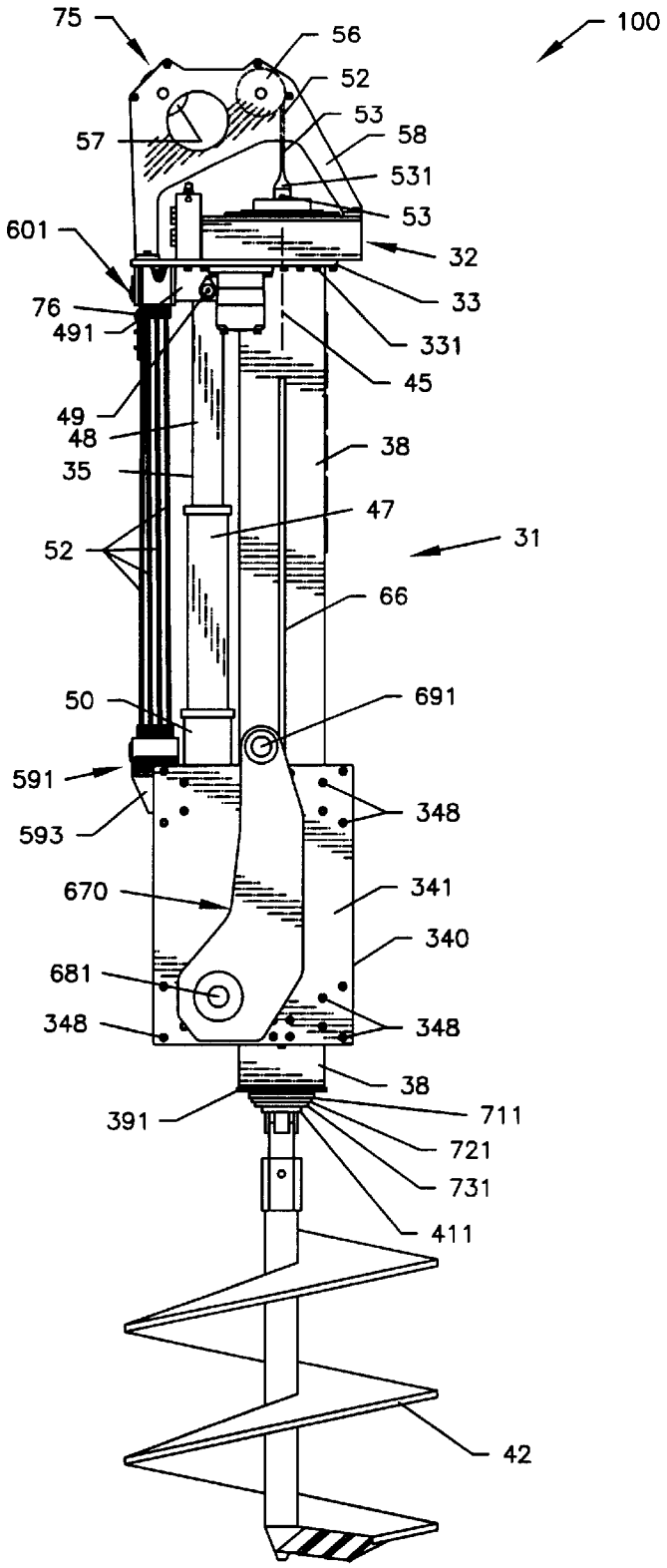
FIG. 8 is a right side view of the excavation apparatus of FIG. 7 this invention with kelly sections fully retracted.
Figure 16:
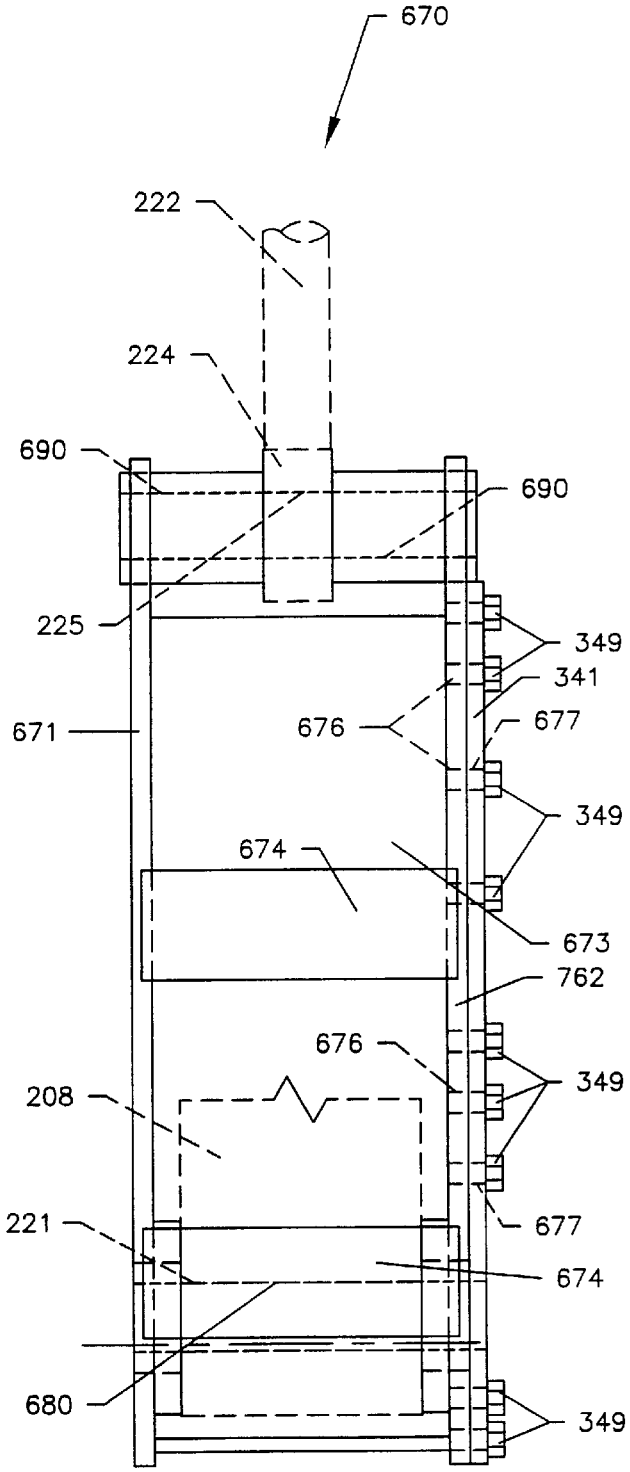
FIG. 16 is a rear view of tilt-connection assembly of FIG. 15.
Figure 17:
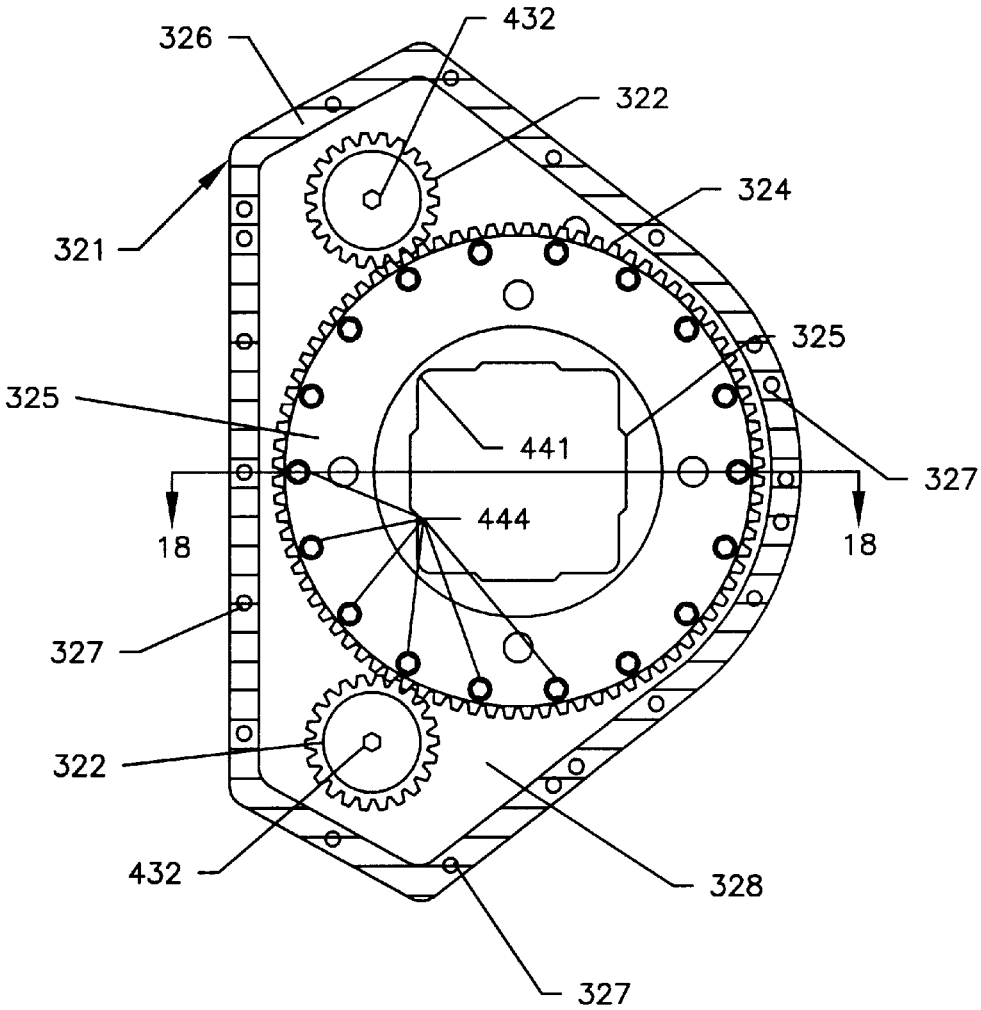
FIG. 17 is an enlarged top view of the gear box body of the kelly rotation means of FIG. 13 but with the cover removed.

Referring also to FIGS. 8 and 16, a distal end of boom 208 is pivotally connected to the excavation apparatus 100 at a point functionally similar to bore 68 in FIGS. 1–6 and specifically by pin means 681 in a conventional manner. The housing base of hydraulic cylinder 218 is pivotally connected at point 220 to boom 208 and a distal end of rod 222 is pivotally connected to the excavation apparatus 100 at a point functionally similar to bore 69 in FIGS. 1–6 and specifically by pin means 691 in a conventional manner, thereby enabling excavation apparatus 100 to be pivoted in the plane of booms 202 and 208. Both hydraulic cylinders 212 and 218 are controlled by conventional hydraulic system control means located in or near shielded operator area 230 of backhoe 200.

Figure 9:
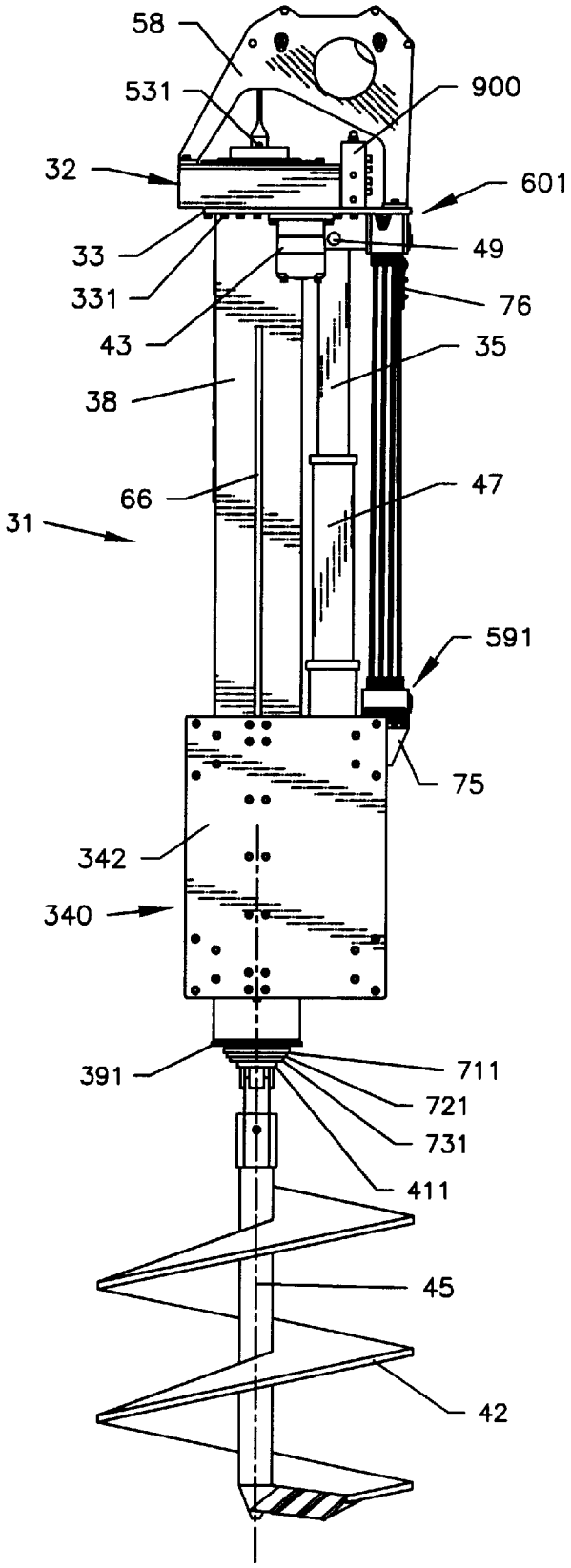
FIG. 9 is a left side view of the excavation apparatus of FIG. 8 with the kelly sections fully retracted.
Figure 10:
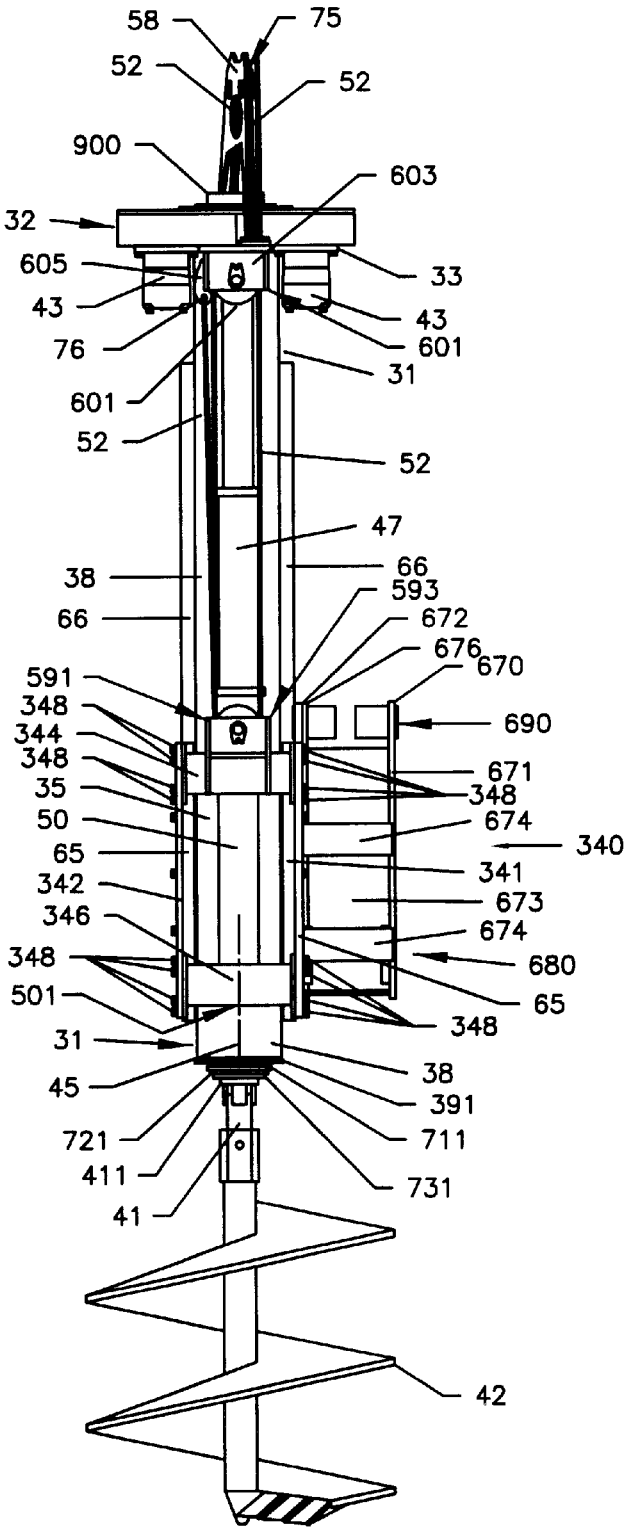
FIG. 10 is a rear view of the excavation apparatus of FIG. 7 this invention with kelly sections fully retracted.
Figure 11:
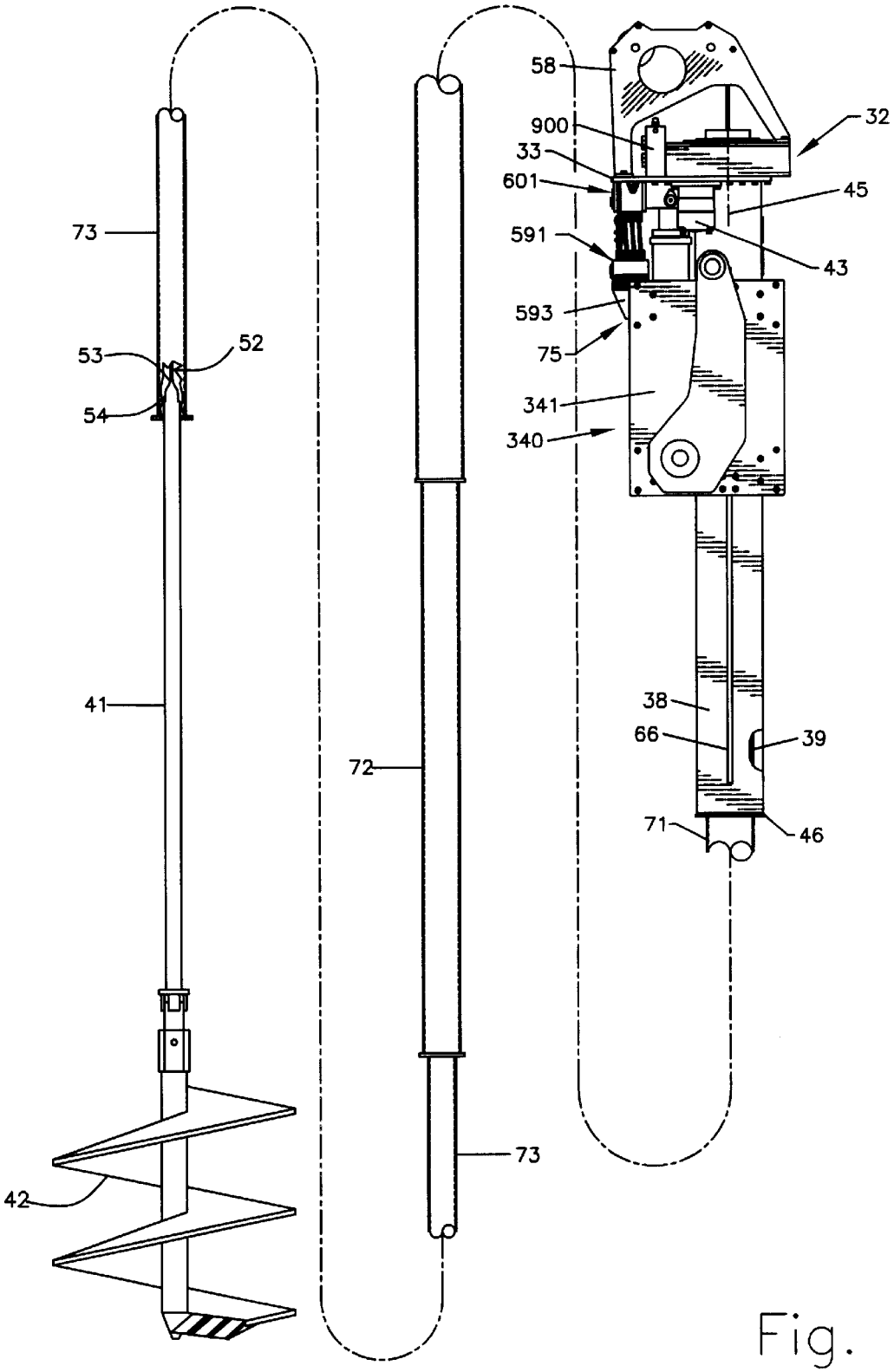
FIG. 11 is a right side view of the excavation apparatus of FIG. 7 with kelly sections fully extended.
Figure 12:
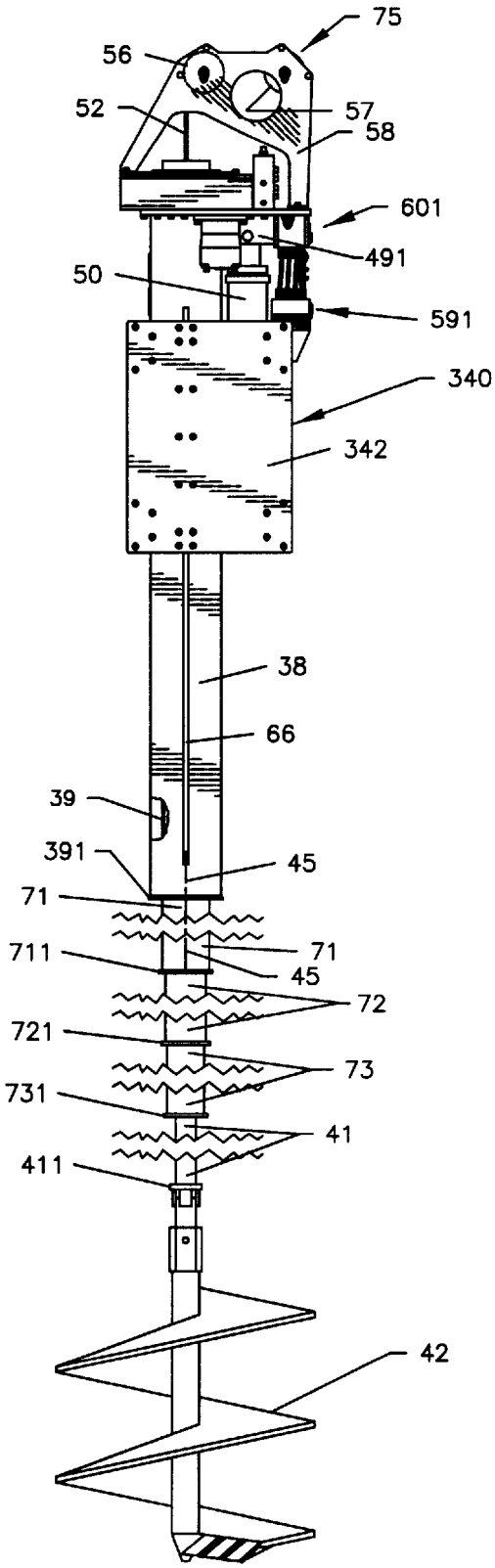
FIG. 12 is a left side view of the excavation apparatus of FIG. 7 with the kelly sections fully extended.
Figure 13:
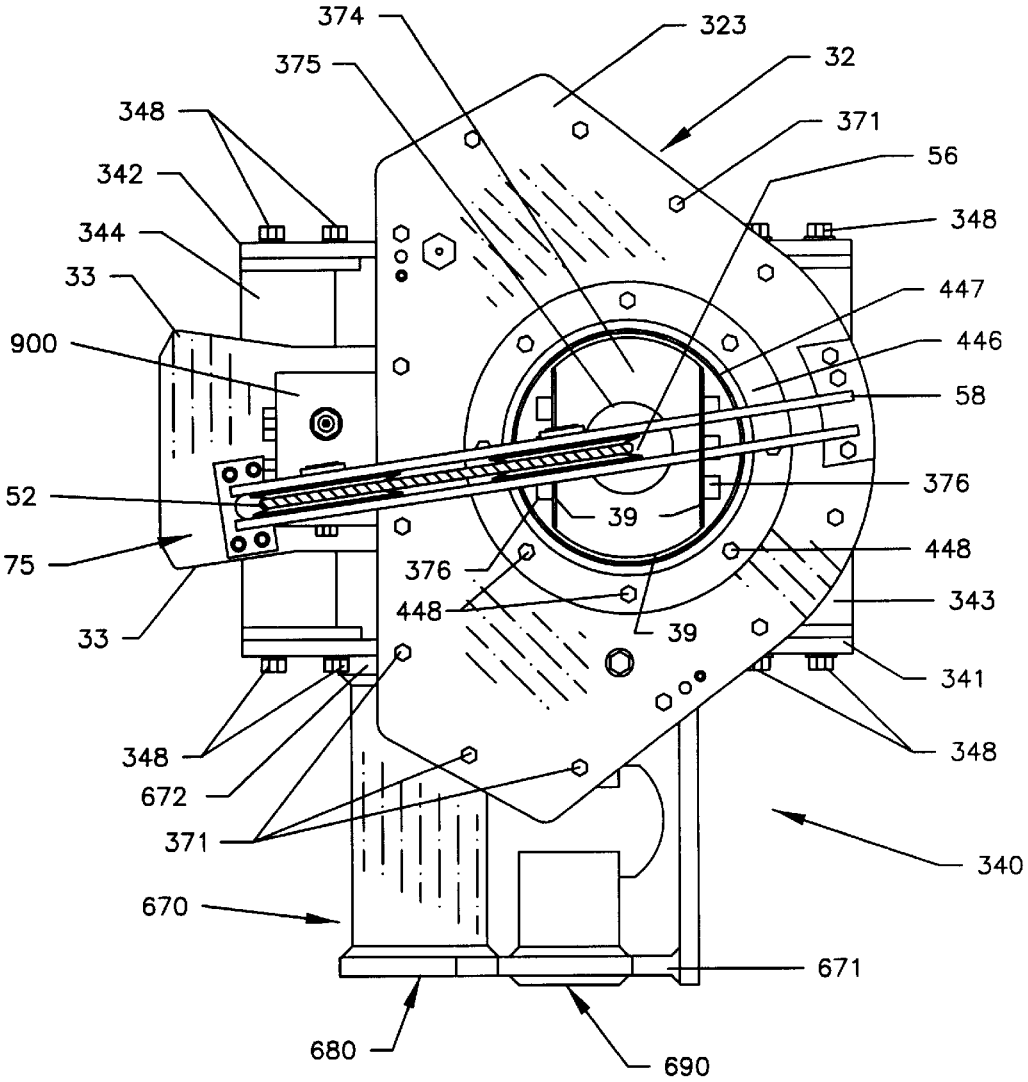
FIG. 13 is a top view of the excavation apparatus of FIG. 7.
Figure 14:
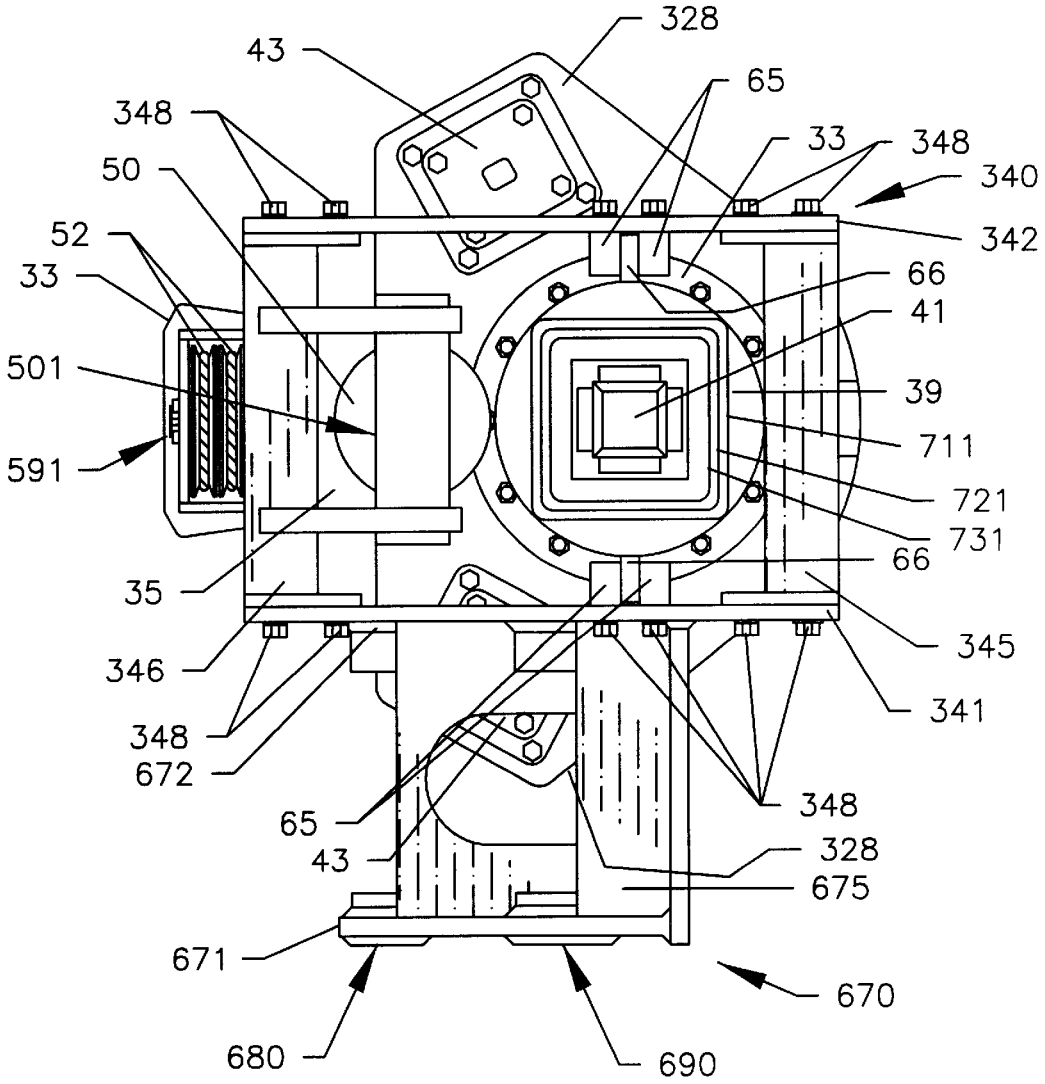
FIG. 14 is a bottom view of the excavation apparatus of FIG. 7.
Figure 15:
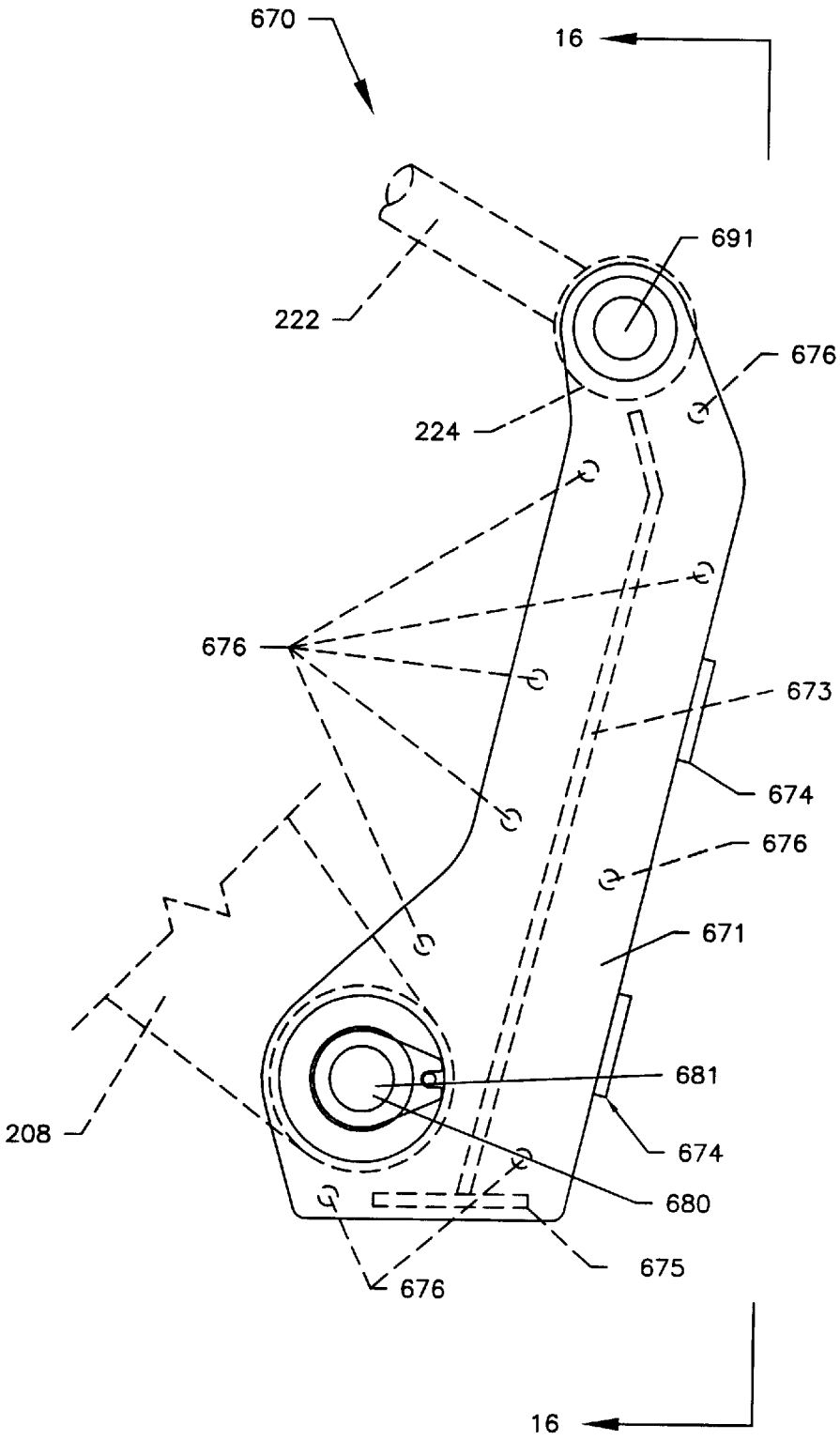
FIG. 15 is an enlarge right side view of the tilt-connection assembly shown in FIG. 8.

Excavation apparatus 100 is similar to above described embodiment 70 in that it has five kelly sections and seven kelly extension sheaves. Excavation apparatus 100 comprises kelly assembly means 31, kelly rotation means 32, support means 33, an frame means 340, downcrowd means 35, and a kelly retraction means 750. In particular, FIGS. 8, 9 and 10 show the right side, left side and rear views, respectively, of excavation apparatus 100 having all its kelly sections fully retracted into annular kelly assembly housing 38. FIGS. 11 and 12 show the right and left side views, respectively, of excavation apparatus 100 with all the extendable kelly sections, i.e. 71, 72, 73 and 41, fully extended from the kelly assembly housing 38. FIGS. 13 and 14 show the top and bottom views, respectively, of excavation apparatus 100. Auguring tool means 42 is not attached in FIG. 14 in order to more clearly show the components of this invention.

Figure 31:
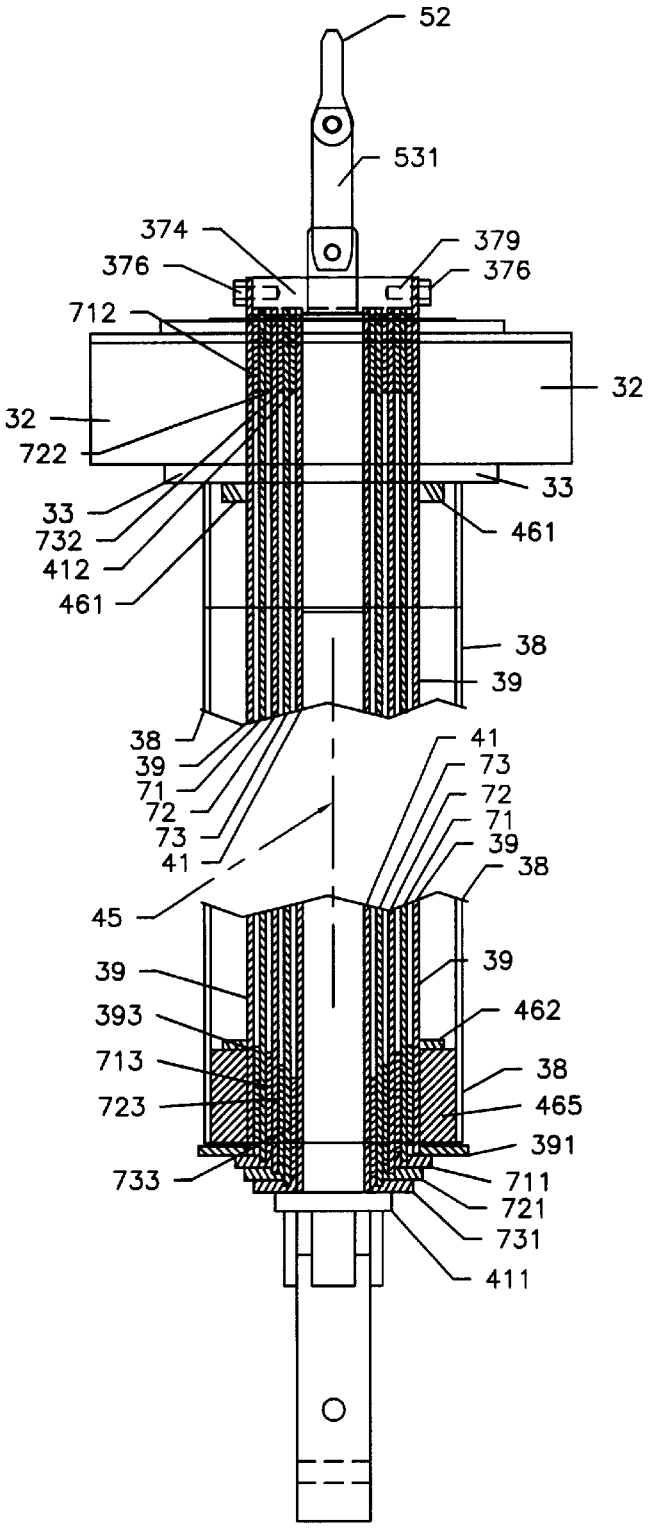
FIG. 31 is a cross-sectional view of the kelly assembly housing of FIG. 8 with kelly sections fully retracted.
Figure 32:
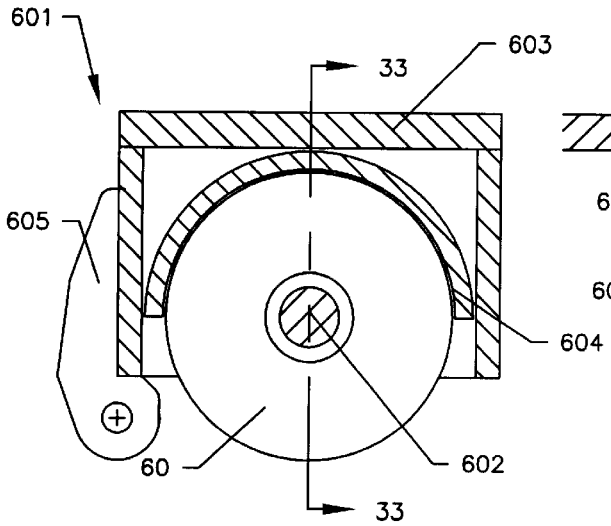
FIG. 32 is an enlarged rear detailed view in cross section of the upper kelly extension sheave assembly.
Figure 33:
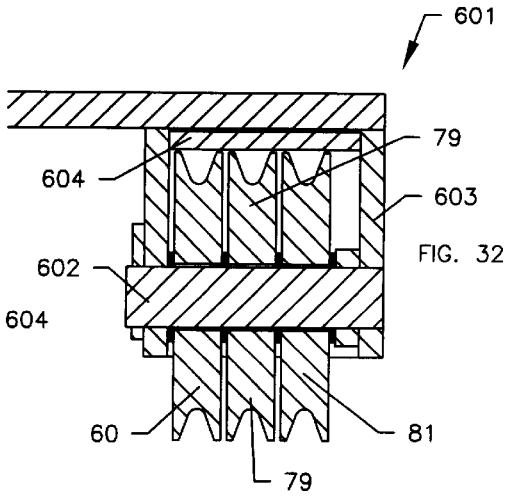
FIG. 33 is a cross-sectional left side view taken through line 33—33 of the upper kelly extension sheave assembly of FIG. 32.
Figure 34:
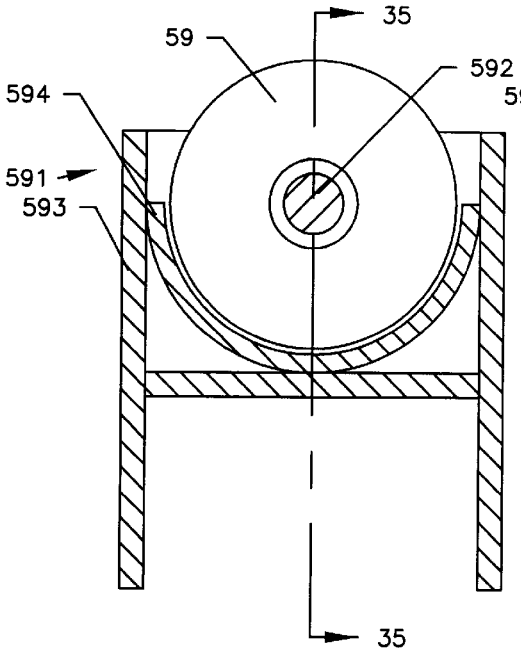
FIG. 34 is an enlarged rear detailed view in cross section of the lower kelly extension sheave assembly.
Figure 35:
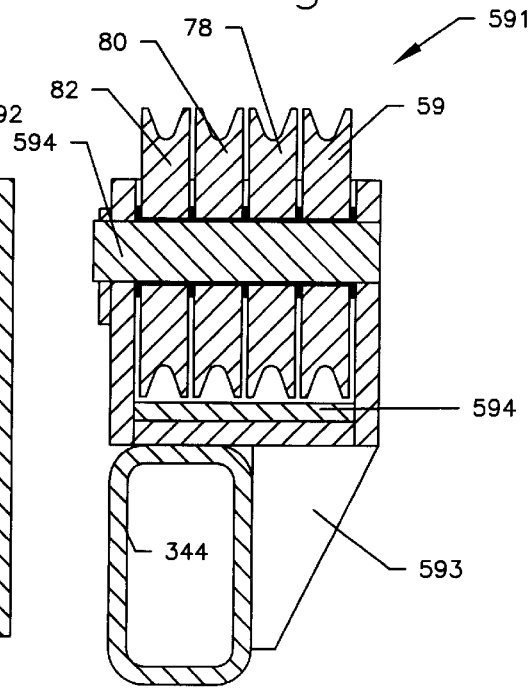
FIG. 35 is a cross-sectional left side view taken through line 35—35 of the lower kelly extension sheave assembly of FIG. 34.

Kelly assembly means 31 comprises the kelly assembly housing 38 which houses five kelly sections, specifically outer kelly section 39, middle kelly sections 71, 72 and 73 and inner kelly section 41 as shown in FIGS. 11 and 31. Non-rotatable kelly assembly housing 38 is cylindrical in cross section. Rotatable kelly sections 39, 71, 72, 73 and 41 are square-shaped annuluses in cross section. As in all embodiments of this invention, the kelly assembly housing 38 is slidable relative to the frame means 340, and outer kelly section 39 remains within kelly assembly housing 38 at all times and is not extendable therefrom. Kelly rotation means 32 rotates outer kelly section 39 which in turn rotate middle kelly sections 71, 72 and 73, which in turn rotates inner kelly section 41. Augering tool means 42 is attached to the bottom of inner kelly section 41 and rotates therewith.

Referring to FIGS. 17, 18, 19 and 20, the kelly rotation means 32 comprises a gearbox body 321 and gearbox cover 323. Gearbox body 321 houses two small pinion gears 322, a large central ring gear and ball bearing race assembly 324, and a kelly drive shroud 325. Gearbox cover 323 has been removed and is not shown in FIG. 17.

Figure 21:
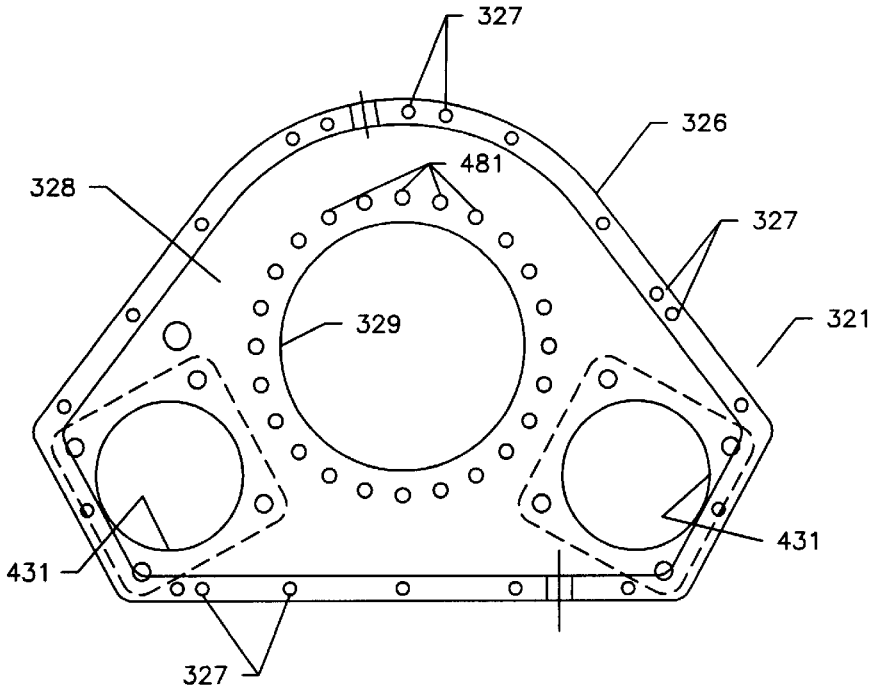
FIG. 21 is a top view of the gear box body of FIG. 13 showing the central circular opening for the outer kelly section and the two smaller right and left circular openings for the two rotary motors.
Figure 22:
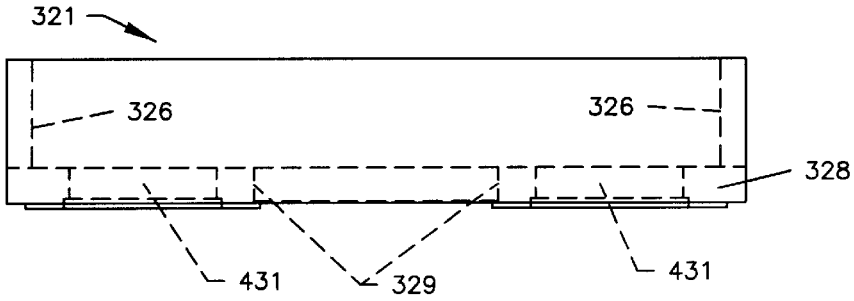
FIG. 22 is a front view of the gear box body of FIG. 21.

Referring also to FIGS. 21 and 22, gearbox body 321 has sidewall portion 326 containing peripheral threaded holes 327, and base portion 328 containing large central opening 329. Gearbox body 321 can be made of 6061-T6 aluminum plate welded together to produce the desired shape. The bottom portion of gearbox body 321 can be machined from 1.5 inch aluminum plate.

Figure 23:
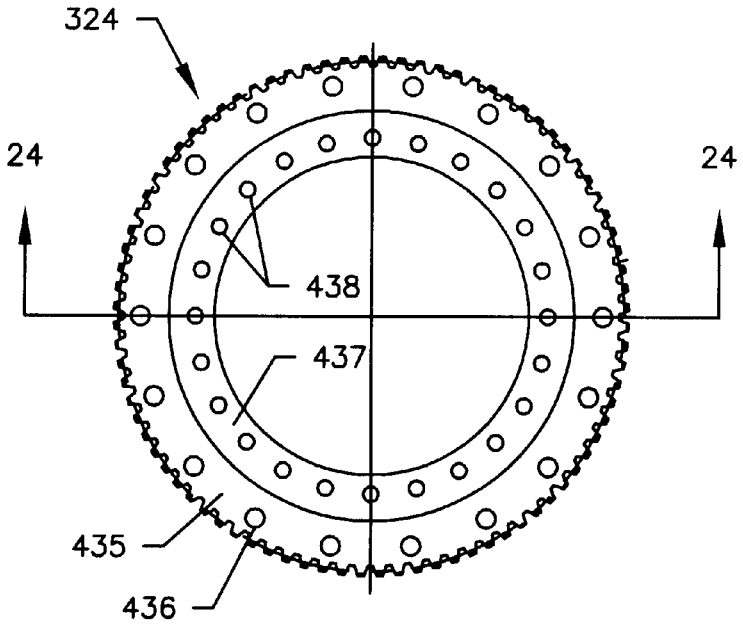
FIG. 23 is a greatly enlarged top view of the central ring gear and ball bearing race assembly shown in FIG. 18.
Figure 24:
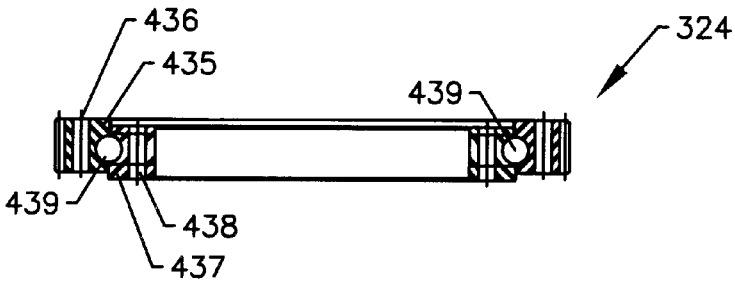
FIG. 24 is a cross-sectional view of the central ring gear and ball bearing race assembly taken through line 24—24 of FIG. 23.

Referring also to FIGS. 23 and 24, ring gear and ball bearing race assembly 324 comprises ring gear portion 435 having threaded holes 436, and ball bearing portion 437 having threaded holes 438. Portions 435 and 437 are separated by ball bearings 439. Assembly 324 is a Kaydon gear which may be purchased from Kaydon Corporation, Muskegon, Mich.

Figure 18:
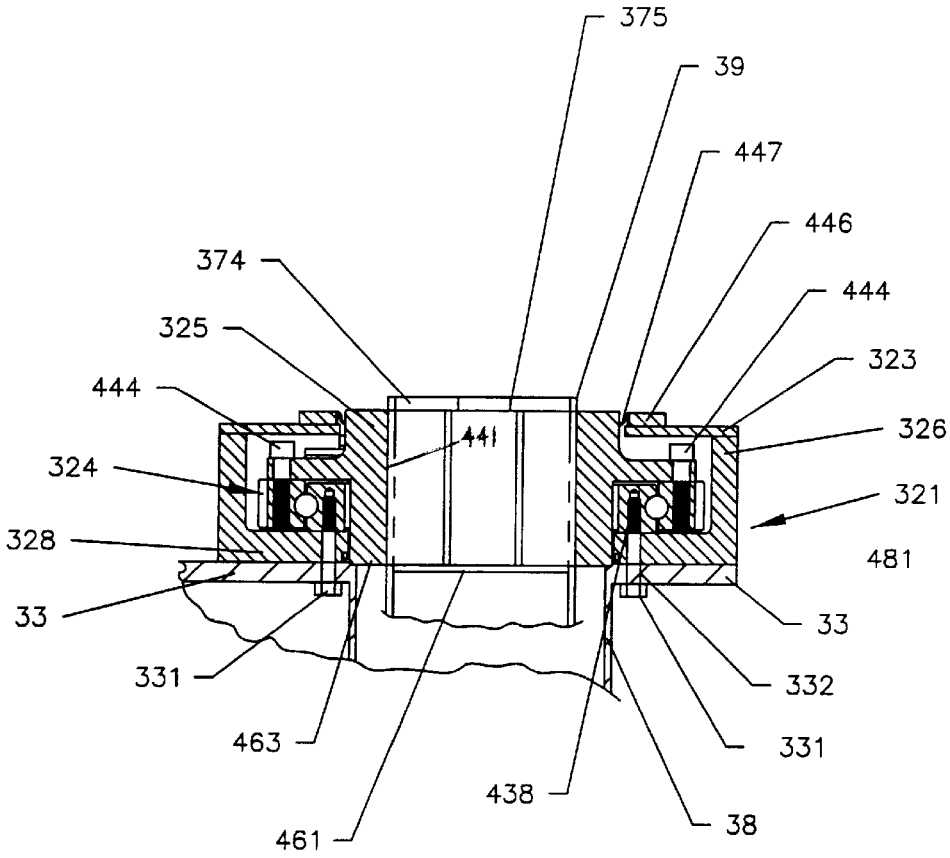
FIG. 18 is a cross-sectional view of the gear box body taken through line 18—18 of FIG. 17.
Figure 19:
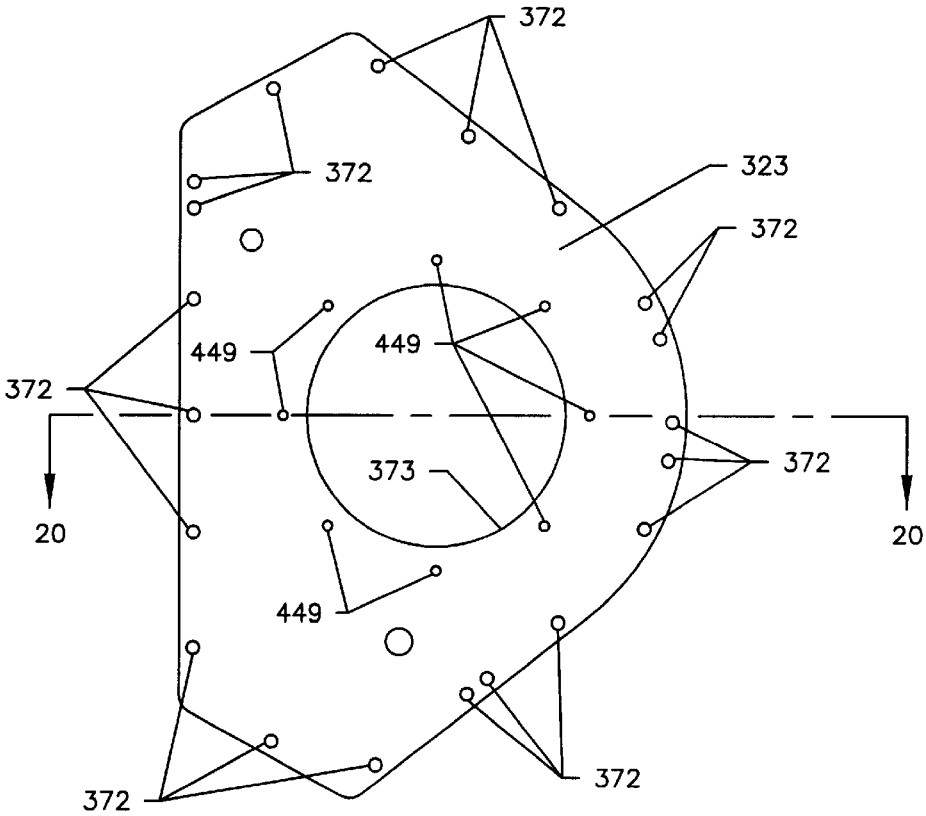
FIG. 19 is an enlarged top view of the cover for the gear box body of the kelly rotation means of FIG. 13.
Figure 20:
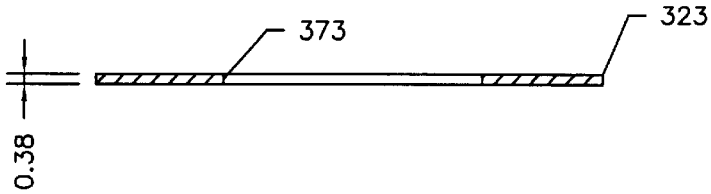
FIG. 20 is a cross-sectional view of the cover taken through line 20—20 of FIG. 19.
Figure 25:
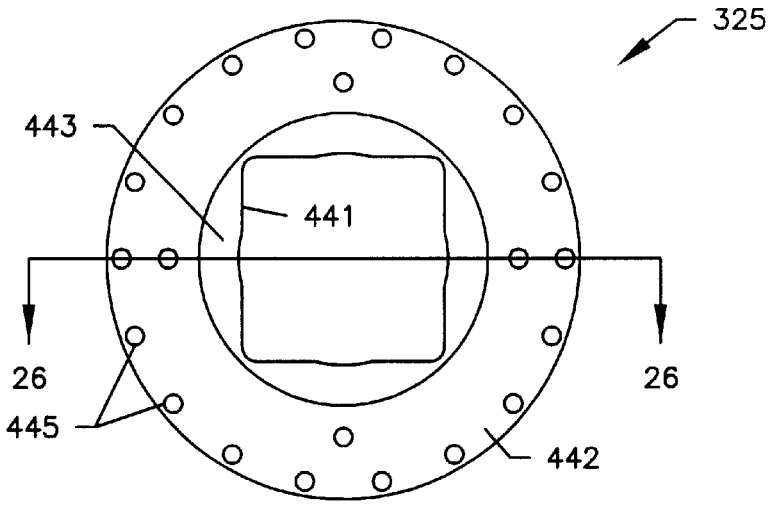
FIG. 25 is a greatly enlarged top view of the kelly drive shroud shown in FIG. 17.
Figure 26:
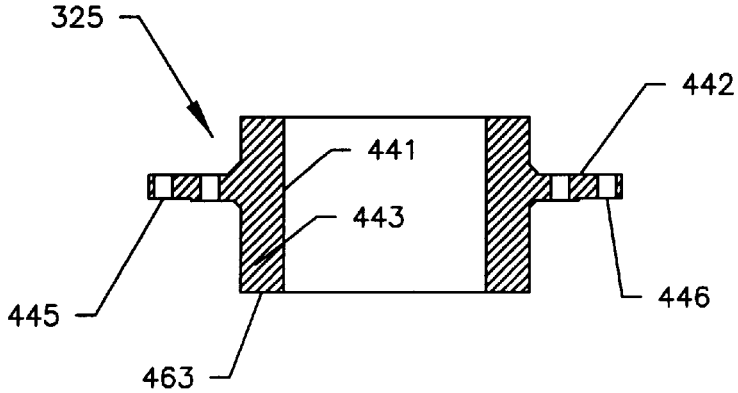
FIG. 26 is a cross-sectional view of the kelly drive shroud taken through line 26—26 of FIG. 25.

Referring also to FIGS. 18, 25 and 26, kelly drive shroud 325 comprises central square opening 441 and flange 442 having holes 445. The kelly rotation means 32 is positioned so that the center of kelly drive shroud 325 coincides with axis 45 of kelly assembly means 31. Opening 441 and flange 442 are separated by wall portion 443. Kelly drive shroud 325 is rotatably attached to assembly 324 by tightening bolts 444 extending through holes 445 in flange 442 and into threaded holes 436 in ring gear portion 435.

Figure 28:
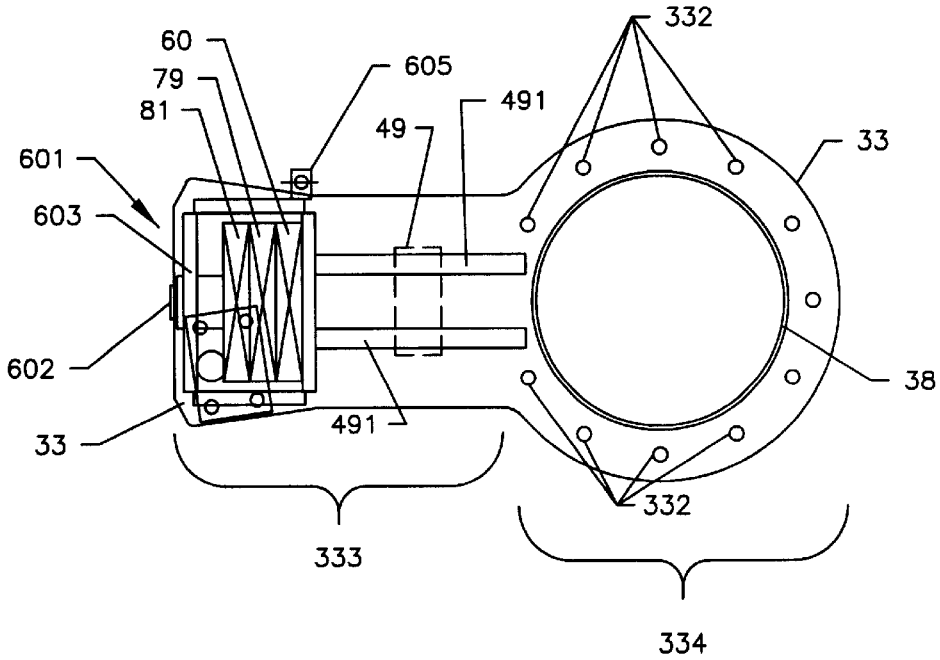
FIG. 28 is a right side view of the support means of FIG. 27.
Figure 27:
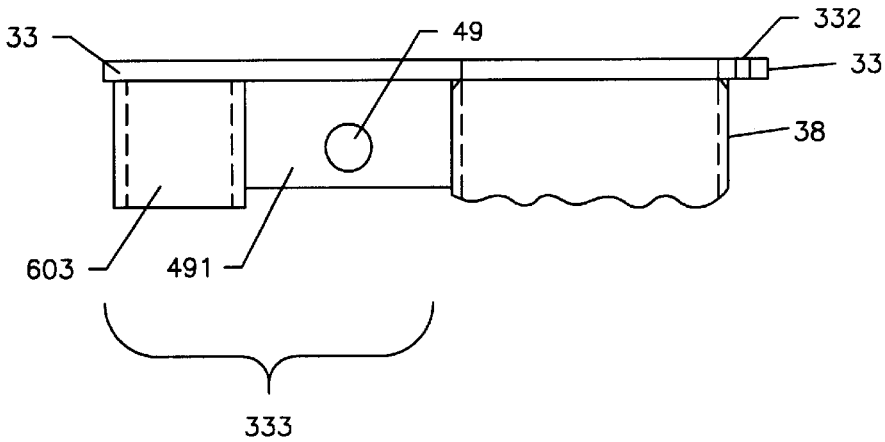
FIG. 27 is a bottom view of the support means of FIG. 14 showing the extended flange portion with upper kelly sheave extension assembly, and the annular flange portion with several bolt holes.

Referring also to FIGS. 27 and 28, the upper most portion of kelly assembly housing 38 comprises an extended flange which, in this embodiment, also function as the support means 33. Support means 33 is bolted to kelly rotation means 32 by tightening bolts 331 passing through holes 332 in the annular flange portion 334 of support means 33, then through holes 481 in base portion 328 of gearbox body 321, then into threaded holes 438 in ball bearing portion of assembly 324, thereby causing base portion 328 to be sandwiched fixedly between support means 33 and the ball bearing portion 437 of assembly 324 as shown in FIG. 18.

Two hydraulically powered rotary motors 43 are mounted in axial alignment with shaped mounting holes 431 in the base portion 328 of gearbox body 321. The shafts 432 of rotary motors 43 drive pinion gears 322, which in turn drive ring gear portion 435 of assembly 324, which in turn drives kelly drive shroud 325, which in turn drives outer kelly section 39. Rotary motors 43 useful for this invention are Danfoss motor model no. OMV500, #151B2157, with a splined 2.125 inch shaft.

Before kelly drive shroud 325 is attached to assembly 324, it is preferable to first attached support means 33 to gearbox body 321 and assembly 324 so that bolts 331 can be seen as they are screwed into threaded holes 438. Thereafter kelly drive shroud 325 is attached to assembly 324 as described above.

Next a seal ring 446 with an annular flexible dust gasket 447 is installed on gearbox cover 323 by bolts 448 screwed into threaded holes 449 in cover 323. Then cover 323 is installed on gearbox body 321 by bolts 371 fed through peripheral holes 372 in cover 323 and screwed into peripheral threaded holes 327 in sidewall portion 326 of gearbox body 321 with gasket 447 being pressed down into large central circular opening 373 in cover 323 against the outside diameter of wall portion 443 of shroud 325.

Figure 30:
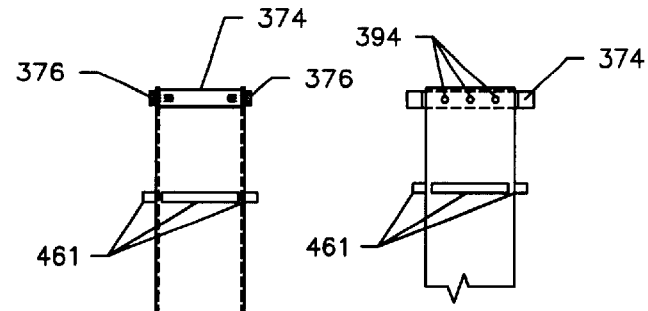
FIG. 30 is a side view of the top portion of the outer kelly section rotated 90° from that shown in FIG. 29, the opposite side view being identical.
Figure 29:
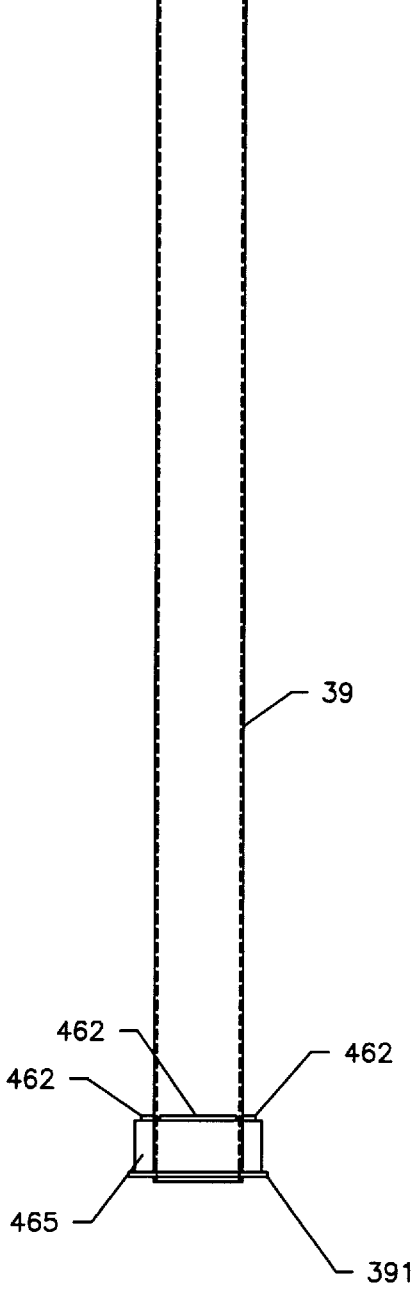
FIG. 29 is a side view of the outer kelly section, the opposite side view being identical.

Referring to FIGS. 29, 30 and 31, outer kelly section 39 has near the top and bottom thereof four metal strips 461 and 462, respectively, on the four sides of outer kelly section 39, and closest to the bottom distal end thereof, a bottom ring 391. Confined between strips 462 and ring 391 is a lower annular bearing 465. Bearing 465 can be made of solid nylon or teflon or any other effective solid plastic or bronze material. An effective material is Nylatron™ brand solid nylon made by Polymer Corp., Reading, Pa. Such plastic bearing is split longitudinally along a radius and can be installed by stretching the plastic bearing apart enough to allow slippage around outer kelly section 39; and when released, the plastic bearing reforms itself into an annulus.

With hydraulic cylinder 47 fully extended, outer kelly section 39 and the four extendable kelly sections 71, 72, 73 and 41 are installed as a concentric unit through the bottom of, and into, kelly assembly housing 38 and into square opening 441 in kelly drive shroud 325 until upper strips 461 abut the lower surface 463 of shroud 325 as shown in FIGS. 13, 18 and 29 to 31. Retainer member 374 is then secured to the top of outer kelly section 39 by screwing bolts 376 through holes 394 into mating threaded holes 379 in retainer member 374, thereby securing outer kelly section 39 in kelly assembly housing 38. Kelly drive shroud 325 and lower annular bearing 465 keep outer kelly section 39 axially centered in housing 38 during rotation of the kelly sections.

The lengths of the kelly sections 39, 71, 72, 73 and 41 are designs so that when the kelly sections are fully retracted into kelly assembly housing 38, their bottom annular lift members 711, 721, 731 and 411, respectively, will be abutted in a stacked relationship against bottom annular member 391 of kelly sections 39, and the top 54 of inner kelly section 41 will be above retainer member 374, after passing through axial hole 375 in member 374, as shown in FIGS. 13 and 31. While maintaining the kelly sections fully retracted into kelly assembly housing 39, swivel 531 is attached to the top end 54 of inner kelly section 41, and cable end 53 is attached to swivel 531 thereby securing the extendable kelly sections, 71, 72 73 and 41, in kelly assembly means 31.

More kelly sections can be included in any given cross sectional area by having upper stops only on two adjacent sides rather than all four sides of kelly sections 41, 73, 72, and 71 as illustrated in FIG. 31. The four faces of the kelly sections will be referred to as the west, north, east and south faces. This is achieved by having upper stops 412 and 722 on the kelly sections 41 and 72, respectively, only on their west and north outer faces while kelly sections 73 and 71 have upper stops 732 and 712, respectively, only on their east and south outer faces. Thus the location of the upper stops on the outer faces is alternated between the west and north pair and the east and south pair of adjacent kelly sections.

Lower stops 733, 723, 713 and 393 on the inner faces of kelly section 73, 72, 71 and 39, respectively, are also provided on the opposite faces as the upper stops. In such arrangement the axes of inner kelly section 41 and outer kelly section 39 can be made to coincide if the total number of kelly sections is an odd number as shown in FIG. 31. If an even number of kelly sections is used then one way of minimizing any eccentricity between the axes of outer kelly section and inner kelly section, if desired, is to make the number of lower stops between the outer kelly section and upper stops on the kelly section adjacent thereto four, thereby insuring that the axes of the inner kelly section 41 and the kelly assembly housing 38 coincides. However, since an even complement of kelly sections would cause a concentric error of only about one eighth of an inch, such corrective measures are generally of little or no concern.

Referring again to FIGS. 7–16, frame means 340 comprises right and left side plate members 341 and 342, respectively, which are rigidly bolted by bolts 348 to upper front and rear traverse members 343 and 344, respectively, and lower front and rear traverse members 345 and 346, respectively. Frame means 340 further comprises tilt-connection assembly 670 having bores 680 and 690 which serves the same function as tilt-connection portion and bores 68 and 69, respectively, shown in FIGS. 1–6. Tilt-connection assembly 670 comprises side members 671 and 672, which are welded to, and separated by, large traverse plate 673 and smaller traverse members 674 and 675. Side member 672 is bolted to right side plate member 341 by screwing bolts 349 extending through holes 677 in right side plate member 341 into mating threaded holes 676 in side member 672, thereby insuring that side plate member 341 moves with side member 672 at all times. A bore 221 in the distal end of boom 208 is positioned between side members 671 and 672 and aligned with bores 680. While so aligned, a boom pin means 681 is inserted through side members 671 and 672 and into bores 221 and 680 and locked into place. A coupling 224 with a bore 225 attached to the distal end of hydraulic cylinder rod 222 is positioned between side members 671 and 672 and aligned with bores 690. While so aligned, a rod pin means 691 is inserted through side members 671 and 672 and into the bores 225 and 690 and locked into place thereby pivotally securing excavation apparatus 100 in a tiltable relationship to boom 208 of backhoe 200.

Frame means 340 also permits kelly assembly housing 38 to slide relative to frame means 340 in a direction which is parallel to, and coaxial with, the axis 45 of kelly assembly means 31. Side members 341 and 342 have bolted thereto a pair of channel forming members 65 which form side bearing channels adaptable for receiving right and left guide rails 66 mounted on diagonally opposed sides of kelly assembly housing 38. Channels formed between channel forming members 65, are designed to permit guide rails 66 and hence kelly assembly means 32 to slide up and down relative to frame means 340 only in the direction of axis 45 of kelly assembly means 31.

With reference to FIGS. 8, 14, 27 and 28, frame means 340 also supports downcrowd means 35 which, in this embodiment, comprises two stage hydraulic cylinder 47. The top distal end of the inner rod 48 of hydraulic cylinder 47 is pivotally connected by pin means 49 to a brace 491 welded to the lower surface of extended flange portion 333 of support means 33. The base of hydraulic cylinder housing 50 is pivotally connected by pin 51 to a brace 501 secured to lower rear traverse member 346 of frame means 340.

Referring additionally to FIGS. 8, 10, 13, 27, 28, and 32 through 35, kelly retraction means 750 comprises redirect sheaves support means 58 with cable redirect sheaves 56 and 57, upper kelly extension sheave assembly 601 with kelly extension sheaves 60, 79 and 81, and lower kelly extension sheave assembly 591 with kelly extension sheaves 59, 78, 80 and 82. Thus in excavation apparatus 100 there are seven kelly extension sheaves. Kelly extension sheaves 60, 79 and 81 are rotatably mounted on a common axle 602 of an upper bracket means 603 which is welded to the lower surface of the extended flange portion 333 of support means 33. Kelly extension sheaves 59, 78, 80 and 82 are rotatably mounted on a common axle 592 of a lower bracket means 593 which is welded to, and supported by, upper rear traverse member 344 of frame means 340. Semi-cylindrical members 594 and 604 prevent cable 52 from dislodging from the seven kelly extension sheaves should any slack develop in the cable when the excavation apparatus is in use.

In this embodiment, cable 52 has one end 53 attached to swivel 531 which is attached to the top 54 of inner kelly section 41. The other end 76 of cable 52 attached to flange 605 which is welded to upper bracket means 603. Cable end 53, swivel 531 and inner kelly top 54 are seen in FIGS. 8 and 31. Cable 52 runs from end 53 upwards and over cable redirect sheaves 56 and 57, downward and under kelly extension sheave 59, upwards and over kelly extension sheave 60, downward and under kelly extension sheave 78, upwards and over kelly extension sheave 79, downward and under kelly extension sheave 80, upwards and over kelly extension sheave 81, downward and under kelly extension sheave 82, and upward to flange 605 of upper bracket means 603 where the cable end 76 is attached.

With regard to the downcrowd means 35, it can be seen that when hydraulic cylinder 47 is in its fully extended position shown in FIGS. 8 through 10, middle and inner kelly sections 71, 72, 73 and 41, are fully retracted into kelly assembly housing 38. However, as hydraulic cylinder 47 is retracted, as shown in FIGS. 11 and 12, support means 33 is pulled towards frame means 340 while simultaneously permitting cable 52 to be played out thereby allowing the middle and inner kelly sections to extend out of and below the lower end 46 of kelly assembly housing 38. The combined weight of the middle and inner kelly sections 71, 72, 73 and 41, and augering tool means 42 helps to keep the cable taut.

As in the previously described embodiments, retracting the kelly sections in embodiment 100 merely requires reversing the procedure; specifically, extending the rods of the hydraulic cylinder 47 to their fully extended positions, as shown in FIGS. 8, 9 and 10, which automatically and simultaneously retrieves that portion of the cable which was played out during downcrowding of the support means 33. Thus, it can be seen that in embodiment 100, no winch is required to retract the cable or the kelly sections, thereby simplifying the excavation apparatus and lowering the manufacturing cost.

In embodiment 100, for every foot that support means 33 is pulled towards frame means 340, eight feet of cable 52 is lowered into kelly assembly means 31 thereby lowering augering means 42 the aforementioned eight feet plus one foot more due to downcrowding of the kelly assembly means itself or nine foot total below frame means 340.

Figure 36:
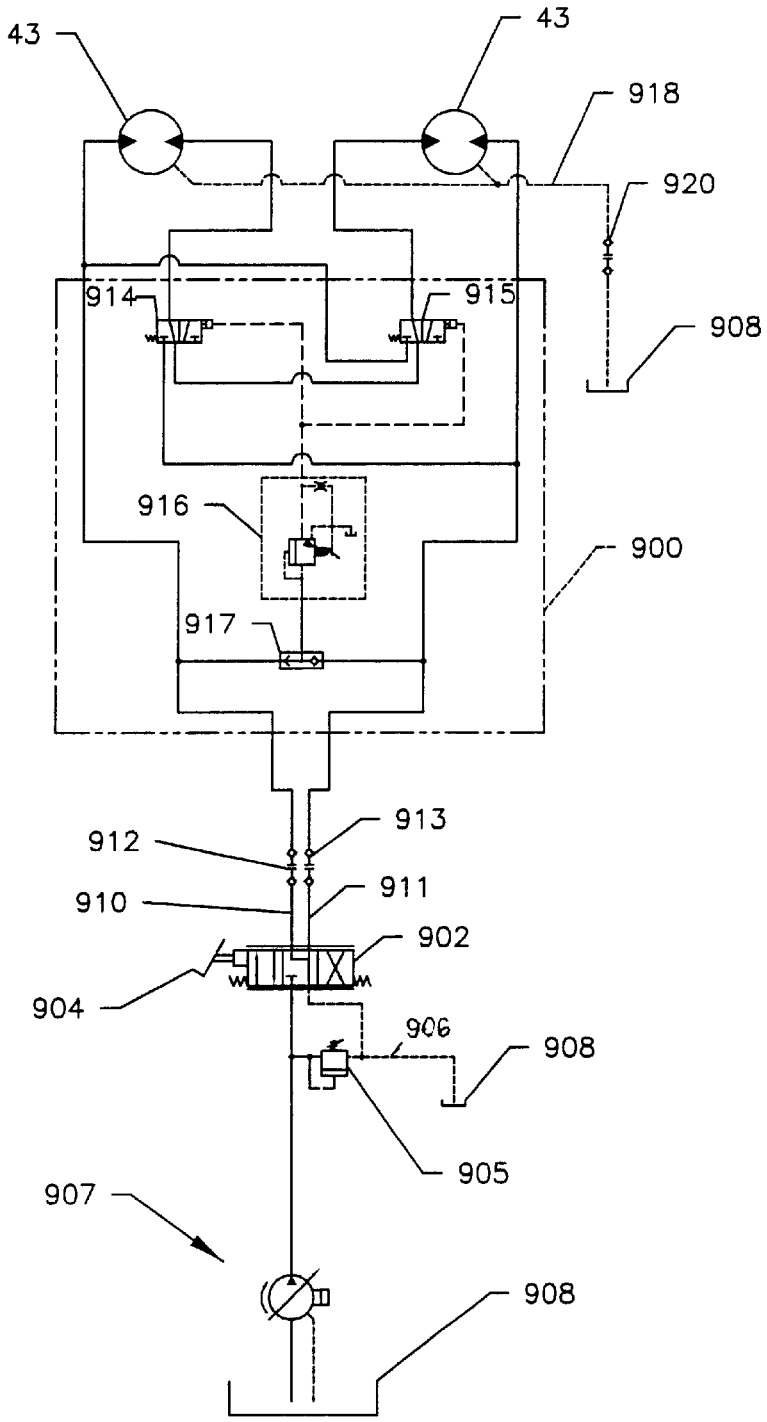
FIG. 36 is a schematic diagram of the hydraulic system for the rotary motors of the excavating apparatus of FIG. 7.
Figure 37:
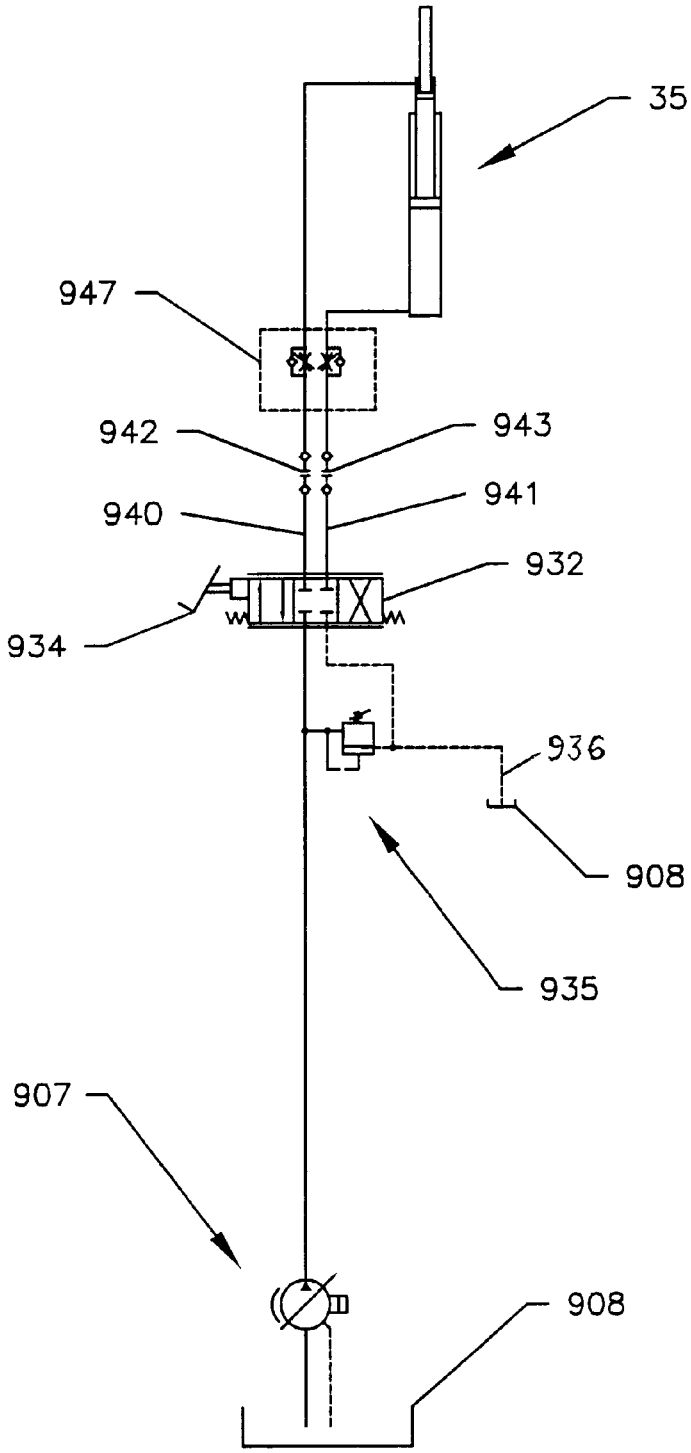
FIG. 37 is a schematic diagram of the hydraulic system for the downcrowd means of FIG. 7.

The hydraulic systems for embodiment 100 are shown schematically in FIGS. 36 and 37. In particular, FIG. 36 illustrates an effective hydraulic circuit for powering and controlling the operation of the rotary motors 43. Control valve 902 having foot peddle 904 is mounted in a convenient operator position in operator area 230 of backhoe 200. Relief valve means 905 can be set to a predetermined pressure, for example 3100 psi to prevent damage to valve 902 and the other hydraulic components in the circuit. Any over pressurization occurring in control valve 902 is relieved through line 906 directly to tank 908.

Hydraulic pump 907 provides a continual source of pressurized hydraulic fluid from hydraulic fluid storage tank 908. Depending on the foot action of the operator on peddle 904, hydraulic fluid flows in forward mode into line 910 into two speed valve block assembly 900 and returns in line 911, or flows in a reverse mode into line 911 into two speed valve block assembly 900 and returns in line 910, thereby causing rotary motors to operate in a forward or drilling mode or a reverse or removal mode, respectively. Two speed valve block assembly 900 is connected to lines 910 and 911 by quick-disconnect fittings 912 and 913, respectively. Two speed valve block assembly 900 comprises pilot operated valves 914 and 915, respectively, and kick down valve 916. Shuttle valve 917 enables forward and reverse flow to occur. Any excess hydraulic fluid leakage from rotary motors 43 into gearbox body 321 (FIG. 22) is drained through line 918 which is connected by quick-disconnect fitting 920 directly to tank 908 thereby preventing over-pressurization of the gearbox.

FIG. 37 illustrates an effective hydraulic circuit for powering and controlling the operation of the downcrowd means 35. Control valve 932 having foot peddle 934 is mounted in a convenient operator position in operator area 230 of backhoe 200. Relief valve means 935 can be set to a predetermined pressure, for example 3100 psi to prevent damage to valve 932 and the other hydraulic components in the circuit. Any over pressurization occurring in control valve 932 is relieved through line 936 directly to tank 908.

Hydraulic pump 907 provides a continual source of pressurized hydraulic fluid from hydraulic fluid storage tank 908. Depending on the foot action of the operator on peddle 934, hydraulic fluid flows in downcrowd mode into line 940 into downcrowd means 35 and returns in line 941, or flows in a retract mode into line 941 into downcrowd means 35 and returns in line 940, thereby causing downcrowd means 35 downcrowd or retract, respectively. Downcrowd means 35 is connected to lines 940 and 941 by quick-disconnect fittings 942 and 943, respectively. Flow control valve means 947 reduces actuation speed to a more controllable rate by metering flow to downcrowd means 35.

Both hydraulic circuits in FIGS. 36 and 37 employ the same hydraulic pump 907 and the same tank 908. It is understood that there is actually only one tank 908.

While the preferred embodiments of the present invention have been described, various changes, adaptations and modifications may be made thereto without departing from the spirit of the invention and the scope of the appended claims. The present disclosure and embodiments of this invention described herein are for purposes of illustration and example and modifications and improvements may be made thereto without departing from the spirit of the invention or from the scope of the claims. The claims, therefore, are to be accorded a range of equivalents commensurate in scope with the advances made over the art.

What is claimed is:

1. An excavation apparatus comprising:

kelly assembly means having an axis, a kelly assembly housing, an outer kelly section, and an extendable inner kelly section adaptable for attachment of a tool;

kelly rotation means for rotating the kelly sections relative to the kelly assembly housing;

support means for supporting the kelly rotation means and the kelly assembly means;

frame means for allowing the kelly assembly housing to slide relative to the frame means in a direction parallel to the axis of the kelly assembly means;

downcrowd means for downcrowding the support means relative to the frame means, the downcrowd means having a first end connected to and supported by the frame means, and a second end connected to and supporting the support means; and kelly deployment and retraction means for deploying the extendable inner kelly section out of the kelly assembly housing and for retracting the extendable inner kelly section back into the kelly assembly housing, the kelly deployment and retraction means having at least one kelly extension sheave supported directly by the frame means, and a cable having a first end attached to the extendable inner kelly section and a second end attached directly to either the support means or the frame means, the cable being looped under a kelly extension sheave of said at least one kelly extension sheave, whereby, the downcrowd means also serves as means for letting out and retracting the cable, thereby enabling the excavation apparatus to function without a winch for letting out and retracting the cable and without a reel for storing the retracted cable.

2. An excavation apparatus comprising:

kelly assembly means having an axis, a kelly assembly housing, a non-extendable outer kelly section, and at least one extendable kelly section which includes an innermost kelly section adaptable for attachment of a tool thereto;

kelly rotation means for rotating the kelly sections relative to the kelly assembly housing;

support means for supporting the kelly rotation means and the kelly assembly means;

frame means for allowing the kelly assembly housing to slide relative to the frame means in a direction parallel to the axis of the kelly assembly means;

downcrowd means for downcrowding the support means relative to the frame means, the downcrowd means having a first end connected to and supported by the frame means, and a second end connected to and supporting the support means; and kelly deployment and retraction means for deploying the extendable kelly sections out of the kelly assembly housing and for retracting the extendable inner kelly sections back into the kelly assembly housing, the kelly deployment and retraction means having at least one kelly extension sheave supported directly by the frame means, and a cable having a first end attached to the innermost kelly section and a second end attached directly to either the support means or the frame means, the cable being looped under a kelly extension sheave of said at least one kelly extension sheave, whereby, the downcrowd means also serves as means for letting out and retracting the cable, thereby enabling the excavation apparatus to function without a winch for letting out and retracting the cable and without a reel for storing the retracted cable.

3. The excavation apparatus of claim 2, wherein the kelly assembly means includes at least one extendable middle kelly section disposed between the innermost kelly section and the outer kelly section.

4. The excavation apparatus of claim 2, wherein the kelly assembly means includes at least guide rail means attached on an outside wall of the kelly assembly housing, and wherein the frame means includes at least bearing channel means effective for sliding along the guide rail means and preventing rotation of the kelly assembly housing relative to the frame means.

5. The excavation apparatus of claim 2, wherein the kelly rotation means includes a kelly drive shroud for rotatably driving the outer kelly section.

6. The excavation apparatus of claim 2, further including rotary motor means for driving the kelly rotation means.

7. The excavation apparatus of claim 2, further including two rotary motors for driving the kelly rotation means.

8. The excavation apparatus of claim 2, wherein the kelly assembly housing is attached to and supported by the support means.

9. The excavation apparatus of claim 2, wherein the downcrowd means is hydraulically powered.

10. The excavation apparatus of claim 2, wherein the downcrowd means includes a multistage hydraulic cylinder.

11. The excavation apparatus of claim 2, wherein the kelly deployment and retraction means further includes redirect cable support means for directing the cable between the innermost kelly section and a kelly extension sheave.

12. The excavation apparatus of claim 2, wherein the kelly deployment and retraction means further includes at least one kelly extension sheave rotatably supported by the support means.

13. The excavation apparatus of claim 12, wherein the cable is looped over the kelly extension sheave rotatably supported by the support means.

14. The excavation apparatus of claim 2, wherein said at least one kelly extension sheave includes a plurality of lower kelly extension sheaves rotatably supported by the frame means and a plurality of upper kelly extension sheaves rotatably supported by the support means.

15. The excavation apparatus of claim 14, wherein the cable is alternately deployed under lower, and over upper, kelly extension sheaves.

16. The excavation apparatus of claim 14, wherein the second end of the cable is attached directly or indirectly to the support means if the total number of lower and upper sheaves is an odd number, or wherein the second end of the cable is attached directly or indirectly to the frame means if the total number of extension sheaves is an even number.

17. The excavation apparatus of claim 14, wherein the plurality of lower kelly extension sheaves is four and the plurality of upper kelly extension sheaves is three.

18. The excavation apparatus of claim 2, wherein the frame means includes connection means for connecting to a distal end of a boom member.

19. The excavation apparatus of claim 2, wherein the frame means includes boom-connection means for connecting to a distal end of a boom member; and tilt-connection means for connecting to a distal end of tilt means.

20. The excavation apparatus of claim 2, further including hydraulically powered rotary motor means for driving the kelly rotation means; and means for hydraulically connecting a hydraulic system to the hydraulically powered rotary motor means.

21. The excavation apparatus of claim 20, wherein the means for hydraulically connecting the hydraulic system to the hydraulically powered rotary motor means includes quick connect hydraulic means.

22. The excavation means of claim 2, wherein the downcrowd means is hydraulically powered; and further including means for hydraulically connecting a hydraulic system to the hydraulically powered downcrowd means.

23. The excavation means of claim 22, wherein the means for hydraulically connecting the hydraulic system to the hydraulically powered downcrowd means includes quick connect hydraulic means.

24. An excavation apparatus for removable and pivotable attachment to a boom means of an excavation machine, the excavation apparatus comprising:

kelly assembly means having an axis, a kelly assembly housing, a non-extendable outer kelly section, and at least one extendable kelly section which includes an innermost kelly section adaptable for attachment of a tool thereto;

kelly rotation means for rotating the kelly sections relative to the kelly assembly housing;

support means for supporting the kelly rotation means and the kelly assembly means;

frame means for allowing the kelly assembly housing to slide relative to the frame means in a direction parallel to the axis of the kelly assembly means, the frame means having boom-connection means for pivotally connecting to a distal end of a boom means of the excavation machine, and associated tilt-connection means for pivotally connecting to a distal end of a tilt means associated with the boom means of the excavation machine;

downcrowd means for downcrowding the support means relative to the frame means, the downcrowd means having a first end connected to and supported by the frame means, and a second end connected to and supporting the support means; and kelly deployment and retraction means for deploying the extendable kelly sections out of the kelly assembly housing and for retracting the extendable inner kelly sections back into the kelly assembly housing, the kelly deployment and retraction means having at least one kelly extension sheave supported directly by the frame means, and a cable having a first end attached to the innermost kelly section and a second end attached directly to either the support means or the frame means, the cable being looped under a kelly extension sheave of said at least one kelly extension sheave supported by the frame means, whereby, the downcrowd means also serves as means for letting out and retracting the cable, thereby enabling the excavation apparatus to function without a winch for letting out and retracting the cable and without a reel for storing the retracted cable.

25. The excavation apparatus of claim 24, wherein the boom means of the excavation machine has a front boom hinged to a back boom, and wherein the boom-connection means is pivotally connected to a distal end of the front boom.

26. The excavation apparatus of claim 24, further including hydraulically powered rotary motor means for driving the kelly rotation means.

27. The excavation apparatus of claim 26, further including hydraulic connect means for connecting the hydraulically powered rotary motor means to a hydraulic system of the excavation machine.

28. The excavation apparatus of claim 26, further including hydraulic quick connect means for quick connecting the hydraulically powered rotary motor means to a hydraulic system of the excavation machine.

29. The excavation apparatus of claim 24, wherein the downcrowd means is hydraulically powered, and further including means for hydraulically connecting the hydraulically powered downcrowd means to a hydraulic system of the excavation machine.

30. The excavation apparatus of claim 24, wherein the downcrowd means is hydraulically powered, and further including quick connect means for hydraulically quick connecting the hydraulically powered downcrowd means to a hydraulic system of the excavation machine.

31. The excavation apparatus of claim 24, wherein the excavation machine is selected from the group consisting of backhoes.

32. The excavation apparatus of claim 24, wherein the excavation machine is selected from the group consisting of backhoes having a boom extension member.

* * * * *